US005782470A

United States Patent [19]

Langan

[11] Patent Number: 5,782,470

[45] Date of Patent: Jul. 21, 1998

[54] SPORTS GAME OF SKILL AND CHANCE

[76] Inventor: Henry G. Langan, 211 Dahlgren Pl., Brooklyn, N.Y. 11228

[21] Appl. No.: 739,174

[22] Filed: Oct. 30, 1996

[51] Int. Cl.[6] ..... A63F 3/06; G06F 15/44

[52] U.S. Cl. ..... 273/139; 273/269; 463/19; 463/41; 463/42

[58] Field of Search ..... 463/18, 19, 41, 463/42; 273/269, 139

[56] References Cited

U.S. PATENT DOCUMENTS

| | | | |
|---|---|---|---|
| 1,639,894 | 8/1927 | Neuzil | 273/277 |
| 3,549,150 | 12/1970 | Weeks | 273/269 |
| 4,169,601 | 10/1979 | Frischmann et al. | 273/269 |
| 4,184,270 | 1/1980 | Presbrey | 434/151 |
| 4,312,511 | 1/1982 | Jullien | 273/237 |
| 4,429,877 | 2/1984 | Coppock | 273/139 |
| 4,509,759 | 4/1985 | Small | 273/269 |
| 4,619,457 | 10/1986 | Small | 273/269 |
| 4,661,906 | 4/1987 | DiFrancesco et al. | 364/410 |
| 4,706,959 | 11/1987 | Price | 273/247 |
| 4,711,454 | 12/1987 | Small | 273/269 |
| 4,768,151 | 8/1988 | Birenbaum et al. | 364/410 |
| 4,856,787 | 8/1989 | Itkis | 273/237 |
| 4,863,173 | 9/1989 | Chen | 273/237 |
| 4,875,686 | 10/1989 | Timms | 273/237 |
| 4,883,277 | 11/1989 | Laisure | 273/236 |
| 4,883,636 | 11/1989 | Fantle, Jr. | 273/269 |
| 4,953,873 | 9/1990 | Jacobson | 273/274 |
| 5,043,889 | 8/1991 | Lucey | 463/18 |
| 5,072,381 | 12/1991 | Richardson et al. | 364/410 |
| 5,112,050 | 5/1992 | Koza et al. | 273/139 |
| 5,332,218 | 7/1994 | Lucey | 463/18 |
| 5,374,060 | 12/1994 | Goldberg | 273/139 |

*Primary Examiner*—Benjamin H. Layno
*Attorney, Agent, or Firm*—Kirschstein, et al.

[57] ABSTRACT

A sweepstakes-type game in which pre-printed game cards are distributed to contestants which permit the contestants to predict the performance of selected players prior to an athletic event and which will reveal winning contestants and associated prizes based upon the geometric arrangement and/or point value of correct predictions.

25 Claims, 14 Drawing Sheets

SPORTS GAME OF SKILL AND CHANCE

BACKGROUND OF THE INVENTION

1. Field of the Invention

The present invention relates generally to games of skill and chance, such as bingo-type, lottery-type, and tic-tac-toe-type games, which are designed for contemporaneous play with an on-going competitive athletic event, such as a game of baseball. In particular, the present invention relates to a sweepstakes-type game in which pre-printed game cards are distributed to contestants which permit the contestants to predict the performance of selected players prior to the athletic event and which will reveal winning contestants and associated prizes based upon the geometric arrangement and/or point value of correct predictions.

2. Discussion of Related Art

While the popularity of professional sports has increased dramatically with increased televised and media coverage of professional sporting events, this growth has not been accompanied by a general increase in stadium attendance, which, in many cases, has steadily decreased in recent years.

For instance, while professional baseball is one of the most widely viewed spectator sports in the United States and many professional baseball games are broadcast nationwide via cable television and satellite, stadium attendance and viewership has diminished to such a great extent in some instances that extreme measures, such as team moves and newly-built ballparks, have been undertaken to attract an increased number of spectators, at great expense to team owners.

One reason for decreased spectator attendance and viewership of professional sporting events such as baseball is the lack of fan participation and recognition in any aspect of the on-going game. Since fans may enjoy the game at home equally as much as in the ballpark, an added incentive is needed in order to attract additional numbers of fans to ballparks.

Another reason for the diminished interest and viewership in traditional professional sporting events includes the increased level of competition from the constantly expanding number of non-athletic entertainment and leisure-related activities. Similarly, traditional competitive sports has in recent years faced increased competition due to the growth of interest and viewership in competitive athletic events which have traditionally not been regarded as widely-viewed spectator sports, such as ice skating, golf and gymnastics. Since nationally broadcast team sporting events comprise a constantly diminishing portion of the ever-increasing spectrum of cable television and satellite-broadcast entertainment programming services, an added incentive is also needed to attract an increased number of viewers to such sporting events.

The sweepstakes-type game of the present invention is intended to restore fan and spectator enthusiasm in team sports, such as baseball and football, to the same high level of intensity experienced in foregone times, when no other competitive athletic events or entertainment activities competed with team sports for spectators and viewers. The game of the present invention is also intended to enhance spectator interest and enthusiasm in an on-going competitive sporting event by directly involving the spectators in the play-by-play action of the sporting event via the use of a pre-printed game card which reveals prizes to spectators based upon the performance of selected athletes in the game. Despite the waning enthusiasm in sporting events when the home team is far behind the visiting team, the game of the present invention is designed to maintain spectator interest in the on-going game irrespective of the score. Thus, the sweepstakes-type game of the present invention creates additional incentive for fan and spectator interest in the normal play-by-play action of an on-going sporting event and will also facilitate a greater familiarity with the individual players' skills, batting rotations, and fielding positions. Additionally, more spectators and viewers will remain involved in the games from start to finish.

In one embodiment of the sweepstakes-type game of the present invention, a spectator/contestant may actually predict the performance of selected athletes prior to the game and prizes are awarded based upon the accuracy of his or her predictions. In another embodiment, the performances of the selected athletes which will result in the awarding of a sweepstakes prize are preassigned, prizes are awarded based solely upon the actual performance of selected athletes, and spectators need not make any predictions. By awarding prizes offered by advertisers and sponsors of the sporting event, spectators and viewers are rewarded for correct predictions of the play-by-play action of the sporting event and an increased number of spectators and viewers is thus attracted to the event.

The prior art offers no similar game of any kind. In this regard, the present inventor has conducted an extensive search in the United States Patent and Trademark Office and has determined that no sports-related game of skill and/or chance currently exists which could be used to suit the interests of fans, teams, and advertisers, and which would nonetheless be successful in enhancing spectator interest, stadium attendance, as well as increasing television and radio audiences.

For instance, while numerous sports-related games of chance have previously been proposed, none of these games is particularly suitable for use with an on-going competitive athletic event. Bingo-style games are disclosed in U.S. Pat. Nos. 3,549,150 to Weeks; and 4,169,601 to Frischmann, et al. Bingo-type promotional games have also been proposed which utilize promotional coupons published, for example, in newspapers. Promotional games are disclosed in U.S. Pat. Nos. 4,509,759; 4,619,457 and 4,711,454 to Small. One example of such a game is disclosed in U.S. Pat. No. 4,706,959 to Price for a quarterback draw football game. While the Price patent discloses a game board which includes a simulated football field having player pieces, movement of the player pieces is determined by decks of cards instead of actual plays in a contemporaneously played football game.

In U.S. Pat. No. 4,184,270 to Presbrey, while a device is used in conjunction with a broadcast golf game, the device is simply a visual aid and is not a game of chance. U.S. Pat. No. 5,112,050 to Koza, et al. discloses a broadcast lottery in which a player acquires a ticket from a transmitter location. The stored information is compared to the broadcast information and, if a match results, the ticket is deemed to be a winning ticket. However, the participant in the lottery does not select, on the basis of skill or chance, predicted batting performances of individual athletes in a competitive sporting event.

In U.S. Pat. Nos. 5,332,218 and 5,043,889 to Lucey, a golf sweepstakes game is disclosed in which contestants predict the winner and runners-up of a golf tournament. Sweepstakes prizes are awarded depending upon the accuracy of the contestants' predictions. The contestants are each provided with a game card having an access number, and a code system allows the contestants to convert their selections into numbers which are input to a computer system along with the contestants' respective access number. The results of the golf tournament are entered into the computer system, and the winner of the sweepstakes is determined in accordance therewith.

In U.S. Pat. No. 1,639,894, a game or puzzle based on baseball is disclosed in which a score card is formed with a series of columns. The first column lists the players of a team while the remaining nine columns each represent a different inning. A guide is provided for defining codes for different plays, each of which can only be used once on the score card. Some innings are blocked out for each of the players. The contestant fills in the blank spaces for each player in the available innings in an effort to obtain the greatest number of runs while completing a perfect score card. The game is relatively difficult to understand, complex to play, highly unrealistic, and does not serve to enhance spectator interest or enthusiasm by allowing spectators to make predictions of the individual performance of selected athletes.

In U.S. Pat. No. 4,883,636 a baseball bingo-type game is disclosed which uses a conventional pre-printed bingo playing card having nine rows which represent nine innings of a baseball game for a visiting team and nine columns which represent the same nine innings for a home team. Each resulting square in the nine-by-nine matrix is pre-printed with a baseball play. When a play on a given space is made by a player on either the home or visiting team, it is covered with a chip or marker by the contestant. As with all conventional bingo games, a winning contestant is determined when a predetermined pattern of zones or spaces is covered by markers (e.g., all the zones in a row, column, or diagonal). This game is highly unrealistic for various reasons. For instance, rather than relating to the play-by-play action of a typical baseball game, the game uses symbols such as hexes and "wildcards", which have absolutely no significance in the context of baseball, and it does not allow for the same plays by different players in the various innings. This patent merely describes a bingo game in which baseball plays are used as "calls" instead of numbers randomly picked from a hopper.

None of the above-described sweepstakes-type games is designed to encourage spectator interest in an on-going athletic event by rewarding contestants for their correct predictions of player performances. While the Lucey patents disclose a golf sweepstakes game in which contestants phone-in or scan-in their predictions to a validation center prior to a golf tournament, they do not disclose a play-by-play sweepstakes game effective to enhance spectator interest, and merely teach a method of downloading, via telephone or computer, individual bets on golf tournaments. The sweepstakes game of the present invention differs substantially from the game disclosed in the Lucey patents by being integrally involved with the play-by-play action of a sporting event and does not simply involve predicting the winner and runners-up of the event. While games directed at merely choosing the winner and runners-up of an athletic event have been demonstrated to enhance spectator interest and enthusiasm in an on-going sporting event, the game of the present invention, which requires predictions related to the play-by-play action of an on-going sporting event, will serve to enhance interest and enthusiasm to a far greater extent. None of the above-described games is similar, and none permits contestants to make predictions of play-by-play performances during an on-going competitive sporting event on the basis of skill or pure chance.

SUMMARY OF THE INVENTION

In view of the foregoing, an object of the present invention is to provide a sweepstakes-type game which can be used to enhance fan and spectator interest and enjoyment as well as to provide a promotional vehicle which serves the interests of professional athletic teams, team owners, advertisers and fans.

Another object of the present invention to provide a sweepstakes-type game of skill and/or chance which may be played individually by an unlimited number of contestants in conjunction with an on-going competitive athletic event, which can be played by contestants having a high level of skill and knowledge of the athletic event as well as by those having absolutely no knowledge thereof, and which can be played using a pre-printed game card distributed to contestants at a ballpark, retail outlet, along with a newspaper or periodical, or in any other venue.

The above and other objects are achieved in accordance with the present invention by providing a sweepstakes-type game of skill and/or chance for use in conjunction with an on-going competitive sporting event.

In accordance with one aspect of the present invention, a plurality of pre-printed game cards are prepared for distribution to contestants. The game cards may be distributed in any known manner, including distribution to spectators at a competitive sporting event, to patrons of a store, a restaurant or bar, or to newspaper or periodical subscribers and/or potential subscribers as part of an advertiser's promotional campaign or subscription drive. The game cards may also be made available for sale or given away in commercial outlets at which games, novelty items, or other sweepstakes-type game cards are available.

The game cards are imprinted with first indicia defining a playing grid which includes a plurality of divided playing areas or sections arranged in a matrix, similar to that of a tic-tac-toe grid. Each of the respective playing areas of the playing grid is associated with a first desired characteristic of a competitive sporting event, such as a fielding position, periodic score, final score, inning, quarter, period, and the like. Within each of the individual playing areas of the playing grid, the game card is further imprinted with second indicia representing a plurality of potential performance possibilities of a team or one or more selected players involved in the competitive athletic event. Thus, by way of example, the plural playing areas may each be assigned to represent a different field position associated with the athletic event and the second indicia may be representative of each of the potential plays that may be made by the athlete associated with the respective field position. In each respective playing area, the game card further includes selecting means, such as scratch-off pads or marking areas, to permit the contestants to predict one or more of the potential performance possibilities. Thus, in the example given above, the selecting means permits the contestants to predict the performance of a particular athlete associated with the respective playing area that is anticipated during the course of the sporting event.

For instance, when used in connection with the game of baseball, the first indicia preferably comprises three rows and three columns of individual playing areas and is arranged in the nature of a conventional tic-tac-toe grid. In this manner, a total of nine playing areas are defined by the three respective rows and columns of playing areas. Since there are nine fielding positions in the game of baseball, each respective fielding position may be associated with one of the nine playing areas of the game card. Most preferably, the playing areas can be arranged similarly to the layout of fielding positions in a baseball game, such that, for example, the top row of three playing areas represents, from left to right, left field, center field, and right field. Similarly, the middle row of three playing areas represents, respectively, short stop, pitcher (or designated hitter), and second base, while the bottom row of playing areas represents third base, catcher, and first base, respectively.

On the other hand, when used in connection with the game of football, the first indicia preferably comprises five rows and five columns of individual playing areas. In this manner, twenty-five playing areas are defined by the five respective rows and columns of playing areas. Preferably, the five rows of playing areas each correspond to a different football team. Four of the five columns of playing areas each represent one of the four quarters of a football game and the fifth column represents the final score.

In order to make the sweepstakes-type game and the manner in which it is played extremely easy for contestants to understand, the game card is most preferably further imprinted with background indicia representing the ball field in which the sporting event is played. In the case of baseball, for instance, the game card may be imprinted throughout the respective playing areas with background indicia representing the infield and outfield of a baseball field, while a game card used in connection with football is preferably imprinted with indicia representing the goal posts and end zones of a typical football field, with the individual playing areas arranged in a grid representing the football playing field.

Most preferably, the periphery of selected playing areas may be imprinted with indicia representing the billboards typical of professional sports stadiums. Most advantageously, the billboards imprinted on the individual game cards are further imprinted with advertisements from individual game sponsors. In one aspect of the invention, the actual sweepstakes prizes awarded to winning spectators are imprinted within one or more of the billboards, along with the identity of the individual game sponsors or advertisers awarding the respective sweepstakes prize.

Furthermore, in the case of baseball, the second indicia within each playing area of the playing grid preferably represents all or some of the potential batting performances, such as a single, double, triple, home run, base on balls, sacrifice bunt or sacrifice fly, strike out, fly out, ground out, and the like. The selecting means preferably comprises a plurality of marking boxes or scratch-off pads, each corresponding to a respective one of the enumerated batting performances, which enables the contestants to select a single or multiple batting performances for each of the nine playing areas of the playing grid. Third indicia may also be imprinted on the game card to record the actual performance of the respective athletes during the course of the on-going game. Preferably, the selecting means permits the contestant to choose only one predicted batting performance for each ball player throughout an entire ball game and the third indicia is in the form of an individual scorecard in each playing area to allow spectators and viewers to record, for personal use and interest, the batting performance of each ball player throughout the course of an entire game. In a more sophisticated aspect of the invention, however, the selecting means permits the contestant to make batting performance predictions for the multiple times at bat of some or all of the ball players on a given team. In another aspect of the invention, the third indicia serves as additional selection means and permits contestants to predict the batting performance of the respective ball players at all their times at bat throughout an entire ball game.

In accordance with a second aspect of the present invention, the individual playing areas are each defined to represent an individual inning of a baseball game rather than the individual field positions. In accordance with this aspect of the present invention, the second and third indicia and the selecting means may be the same or similar to that used in the first aspect of the invention described above. Thus, contestants are permitted to select one or more batting performances which are predicted to occur within each of the nine innings of the baseball game rather than predicting the batting performance of individual ball players.

In accordance with either of these aspects of the present invention, winning contestants are preferably determined based upon the geometric arrangement of playing areas in which correct predictions have been made. In the case of baseball, in which the playing grid is arranged in the nature of a conventional tic-tac-toe game, the winning geometric arrangements are also similar to a tic-tac-toe game. Thus, for instance, winning combinations of correctly-predicted playing areas are three up, three across, or three diagonally, as in tic-tac-toe. In such case, the individual billboard which is aligned with the three adjacent playing areas in which correct predictions have been made is most preferably used to reveal the sweepstakes prize associated with that particular winning combination.

In accordance with a third aspect of the present invention, the second indicia imprinted on the game card defines a plurality of potential batting performances, and each of the enumerated batting performances has selecting means adjacent thereto, as in the first and second aspects of the invention. In the third aspect of the invention, however, each of the batting performances is assigned a predetermined point value. The total point value for each such game card is based not only on the geometric pattern of correctly predicted batting performances, but also the associated point values.

In accordance with a fourth aspect of the present invention, the game card may take any of the general forms described above in connection with the first through third embodiments. Thus, by way of example, the game card preferably includes first printed indicia defining a plurality of playing areas arranged in a grid, such as a tic-tac-toe grid. The card is preferably provided within each playing area with second indicia comprising a list of some or all of the potential batting performances. In accordance with this aspect of the invention, however, the game card is further imprinted with removable opaque marking means, such as scratch-off pads, associated with each of the enumerated batting performances. During the on-going baseball game, contestants manually remove the marking means associated with the actual batting performance of the respective ball players, on a play-by-play basis. Beneath each of the individual removable marking means, the game card is further imprinted with prize-revealing indicia which indicates a particular potential sweepstakes prize. Winning contestants are determined based upon the geometrical arrangement or simply the number of matching prize-revealing indicia revealed at the end of the baseball game. In accordance with this aspect of the present invention, the selection means for permitting the contestants to make individual predictions may be omitted, if desired. However, if the selection means is included, additional sweepstakes prizes, or prizes of greater value, may be awarded based upon correct predictions, as in the first through third aspects of the invention.

In other aspects of the invention, instead of fielding positions or innings in a baseball game, the individual playing areas of the playing grid may be arranged to correspond with the batting rotation or fielding position number. Similarly, rather than basing the game on the batting performance of participating ball players on a single team, the game may be based upon the batting performance of selected players on two competing teams. Furthermore, the playing grid can also be arranged based upon any selected number of players in a single game or multiple games, and may even be based upon the performance of a single player in multiple games. Moreover, instead of distributing individual game cards to each contestant, the game of the present invention may be played by one or more persons using a larger game board. For instance, a plurality of contestants may make batting performance predictions on a single game board by assigning unique or distinguishing selection means characteristics to each such as shape, color or size. Similarly, the game may be implemented in computer software such that the playing grid appears on the screen of a CRT rather than on individual game cards or boards.

In yet another aspect of the present invention, the game is designed for use in conjunction with a plurality of contemporaneously played football games. For example, four of the columns of playing areas are each assigned to represent one quarter of each football game. The fifth column of playing areas is assigned to represent the final score of each of the games. In each respective playing area, the game card is provided with selecting means to permit the contestant to predict, for each football team, the team's score in each quarter of a football game, and the final score of the game. As in the previous aspects of the invention, winners are determined based upon the geometric pattern and/or point value of correct predictions and billboards may be included in the above-described manner to reveal the identity of sweepstakes prizes.

The sweepstakes-type game of the present invention may be played in any venue, and the game card may be a game board, an electronic display, such as a computer monitor, or the like, and may be played with a contemporaneously played sporting event, a simulated game (i.e., as in a computer generated game), or a previously played game. For example, in a preferred mode of play, game cards are distributed to contestants for use in conjunction with a contemporaneously played game. In another preferred mode of play, game cards are included in newspapers or periodicals for use in connection with a subscription drive. In yet another preferred mode of play, the game is used in combination with a recorded version of a historically significant game and contestants are challenged by being asked to predict the actual performance of famous old-time ball players.

BRIEF DESCRIPTION OF THE DRAWINGS

The above and other objects, features and advantages of the present invention will become apparent from the following description, when read in conjunction with accompanying drawings, wherein there are set forth by way of illustration and example various embodiments of the present invention, in which.

DETAILED DESCRIPTION OF THE PREFERRED EMBODIMENTS

Figure 1:
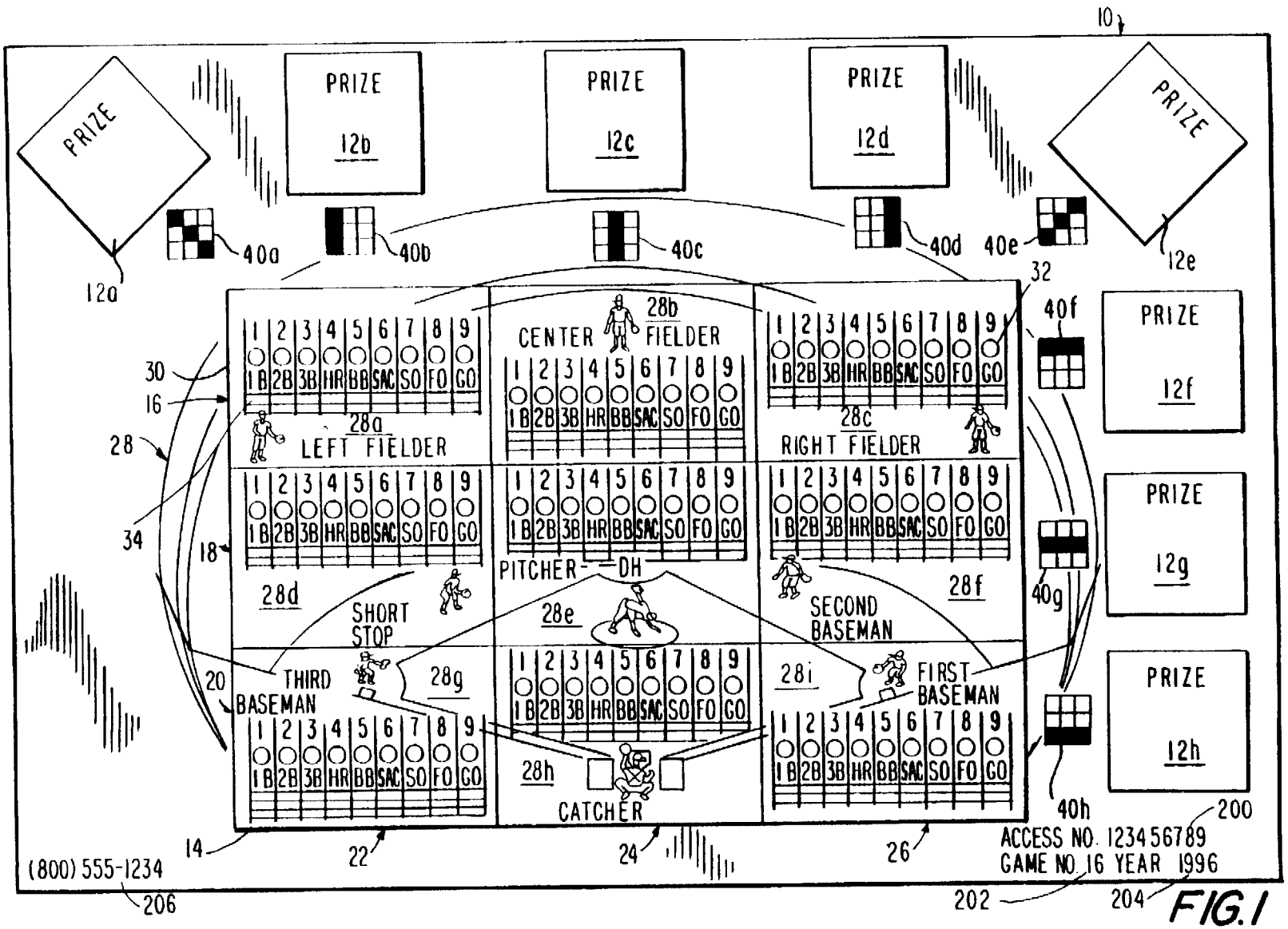
FIG. 1 shows a game card in accordance with a first embodiment of the present invention, in which the game is embodied as a baseball sweepstakes game and the individual playing areas are arranged to define individual ball players on a given team.

Referring specifically to the attached drawings, in which identical or similar elements are designated by the same reference numerals throughout, various embodiments of the present invention will now be described. The sweepstakes game of the present invention may be played in a variety of different venues, including baseball stadiums, commercial establishments, private residences, and the like. When played in any of these venues, the game may take any of a number of preferred forms, each of which will be described below.

FIG. 1 illustrates a first embodiment of the present invention. The baseball sweepstakes game is played with the use of a pre-printed game card, denoted generally by reference numeral 10. The baseball sweepstakes game is preferably played in conjunction with an on-going baseball game in which contestants predict the performance of individual players prior to the commencement of a specific baseball game. However, the game can also be played using the results of a previously played game (i.e., for nostalgic purposes), or a simulated game (e.g., by computer).

As illustrated in FIG. 1, the pre-printed game card 10 is in the nature of a rectangular sheet of paper or light stock cardboard not unlike those frequently used in conjunction with bingo games and/or lottery-type sweepstakes games.

Although the invention will be described with reference to individual pre-printed game cards 10, it will become evident that larger boards may be used commonly by a plurality of players. Also, video screens, optical card scanners, or keyboards (such as a computer keyboard or the keypad of a conventional dual tone multifrequency "DTMF" telephone unit) may be used in conjunction with or in lieu of a game card 10 to enter data by a player into a central validation computer. As long as the player can specify, on location or remotely, his or her player performance predictions, any known device capable of receiving and storing and/or displaying selections by a contestant may be used in conjunction with or in lieu of a game card for the purposes of the present invention.

A portion of game card 10 is imprinted to resemble a baseball stadium having a field area and a plurality of billboards 12. The game card 10 is imprinted with first indicia 14 which defines a plurality of rows 16, 18, 20 and columns 22, 24, 26, the rows and columns being mutually orthogonal to form a playing grid 28 consisting of a plurality of individual playing areas or "boxes" 28*a*–28*i*. Each box 28*a*–28*i* is associated with a different field position in a baseball field. While in the preferred embodiment, printed indicia 14 is a series of interconnected boxes 28*a*–28*i*, it may instead be a series of interconnected or closely spaced regions of any desired geometric shape and pattern, or may simply comprise a series of orthogonal lines similar to a conventional tic-tac-toe grid. As long as the first indicia 14 is capable of defining a plurality of individual playing areas, the precise nature thereof is not important.

As shown in the drawing, each box 28*a*–28*i* is assigned to designate a different area of a baseball field. Accordingly, boxes 28*a*–28*i* are assigned the following field areas: left field 28*a*, center field 28*b*, right field 28*c*, short-stop 28*d*, pitcher (or designated hitter) 28*e*, second base 28*f*, third base 28*g*, catcher 28*h* and first base 28*i*. It will be clear that when the game 10 is used in conjunction with a sporting event other than baseball, a different arrangement of playing areas or sections will be used and each, of course, will represent different field positions, athletes, or any other desired characteristic associated with the particular sporting event. In the embodiment presently being described, however, the three rows 16, 18, 20 and three columns 22, 24, 26 defining the nine playing areas or sections of the playing grid 28 as shown are arranged in the same format as a typical tic-tac-toe grid. While the first indicia 14 may include boxes, as illustrated in FIG. 1, for forming the individual playing areas, it may also include solid or broken lines, or vertical and/or horizontal spaces.

In accordance with an important feature of the present invention, second printed indicia 30 is provided in each of the boxes 28*a*–28*i* of the playing grid 28 to represent any one of the plurality of potential batting performances for each of the players. The second indicia 30 may therefore be a listing of all, most, or some of the typical potential batting possibilities for each of the enumerated players in the boxes 28*a*–28*i*. In addition, the second indicia 30 may be a list of the same or different potential batting performances for each of the different players associated with the respective boxes 28*a*–28*i*. In the embodiment currently being described, the second printed indicia 30 is the same for each of the boxes 28*a*–28*i* and consists of common batting performances executable by players during a baseball game. In the FIG. 1 embodiment, the enumerated batting performances are set forth using the following abbreviations:

1B 2B 3B HR BB SAC SO FO GO

The abbreviations shown above are described as follows:

1. 1B A mark in this spot signifies the contestant's prediction of a one base hit (single) by the fielder shown in that square when he comes to bat during any of his times at bat in this game.
2. 2B A mark in this spot signifies the contestant's prediction of a two base hit (double) by the fielder shown in that square when he comes to bat during any of his times at bat in this game.
3. 3B A mark in this spot signifies the contestant's prediction of a three base hit (triple) by the fielder shown in that square when he comes to bat during any of his times at bat in this game.
4. HR A mark in this spot signifies the contestant's prediction of a four base hit (home run) by the fielder shown in that square when he comes to bat during any of his times at bat in this game.
5. BB A mark in this spot signifies the contestant's prediction of a base on balls (walk) (Also, for the purpose of this contest, batter hit-by-pitch) by the fielder shown in that square when he comes to bat during any of his times at bat in this game.
6. SAC A mark in this spot signifies the contestant's prediction of a successful sacrifice fly or sacrifice bunt by the fielder shown in that square when he comes to bat during any of his times at bat in this game.
7. SO A mark in this spot signifies the contestant's prediction of a strike out by the fielder shown in that square when he comes to bat during any of his times at bat in this game.
8. FO A mark in this spot signifies the contestant's prediction of a flyout (fair or foul, pop up or line drive) by the fielder shown in the square when he comes to bat during any of his times at bat in this game. (Also, for the purpose of this contest, when a batter gets on base due to a fly ball error or a fly ball fielder's choice out).
9. GO A mark in this spot signifies the contestant's prediction of a ground out by the fielder shown in that square when he comes to bat during any of his times at bat in this game. (Also, for the purpose of this contest, when the batter gets on base due to a ground ball error or a ground ball fielder's choice out.)

It should be clear that the batting performances enumerated above are not critical and any number and any combination of batting performances or other typical plays may be used. The same or different combinations of batting performances or plays may be provided in each of the boxes 28*a*–28*i*, and arbitrary point values may be assigned to each of the enumerated batting performances or plays.

Marking areas 32 are provided for marking each playing area or section 28*a*–28*i* with a contestant's predictions of the batting performance of each of the players on either the home team or the visiting team in the baseball game. One variation of this theme is where the playing areas are arranged to represent selected players on both teams. In accordance with another variation, the playing areas are intended to represent the performance of one or more individual ball players over the course of multiple ball games. In each such variation, appropriate means are provided to permit contestants to record their predictions. In the embodiment presently being described, for example, such means comprise marking areas 32 which are small circles that allow the contestant to shade in his or her batting performance prediction in the respective playing areas 28*a*–28*i* for each of the baseball players associated with the respective playing areas 28*a*–28*i*. Accordingly, the contestants may manually mark, for example, by shading selected circles 32 using a pencil or pen, or by placing a cross or check mark in selected circles to distinguish or differentiate the predicted batting performance from the other, non-selected batting performances. It should be evident, however, that the specific nature of the marking areas is not critical and any means, arrangement or device may be used to appropriately or adequately mark a predicted batting performance for each of the playing areas 28*a*–28*i*. Thus, by way of example, the marking areas 32 may also comprise scratch-off pads, punch out holes, peel-off labels, or decals, in the case of a smaller-sized game card, and may also comprise game pieces, stick pins, magnets, lights, or the like, in the case of larger game boards. When the game is embodied in computer software and the game card is illustrated as a graphical representation on an electronic display such as a CRT or liquid crystal display device, the marking areas may comprise electronic or computerized indicators, or the like, which allow selection by entry of a predetermined keystroke, mouse movement, or the like. The nature of the marking areas is not critical although the nature or size of playing card, board, or screen used to play the inventive game may dictate or limit the type of marking means that can be used. Where larger boards are to be used by a plurality of players, for example, each player may be assigned a unique or distinguishing marking means characteristic, such as shape, color, or size.

In the presently described embodiment, the object of the game is to correctly predict one batting performance for each of the nine players of a selected baseball team (i.e., the home team or visiting team) during all times at bat in a single game. Players are not named but are identified as they come to bat by their assigned fielding positions. In FIG. 1, the fielding positions are illustrated on the game card 10 in a view of a baseball field from the stands behind home plate with different locations of fielders' positions within the respective playing areas 28*a*–28*i* of the grid.

A selection is made by shading one of the nine marking areas 32 within each playing area 28*a*–28*i* with, for example, a pencil or pen. Each contestant is to complete his or her predictions on the game card 10 and submit it for judging prior to the start of the playing of the baseball game. As noted above, only one batting performance prediction is made in each playing area, for a total of nine marks within the grid 28 of the game card 10.

Winners will be officially determined upon the completion of the baseball game that is used in a respective sweepstakes.

In an alternate mode of play, the marking areas 32 are replaced by scratch-off pads and contestants are instructed to make their batting performances predictions by manually removing the appropriate scratch-off pad in each playing area.

A unique and novel aspect of the present invention is that it provides a sweepstakes-type game requiring a large number of contestant choices and which may nonetheless be easily understood by contestants without the need to resort to detailed instructions. By arranging the individual game components to resemble a playing field for a particular sport, the game card 10 conveys information to the contestant on a user-friendly basis, thus instructing the contestant, for example, that playing area 28*a* is the location in which the contestant's prediction for the left fielder is placed, playing area 28*b* is the location in which the contestant's prediction for the center fielder is placed, etc. This user-friendly manner of conveying instructional information to the contestant facilitates a nearly instantaneous understanding of the rules of the sweepstakes game even by persons having little knowledge of the particular sporting event. Thus, there is no need for the contestant to resort to detailed instructions which are overly burdensome and which, in any event, are difficult to discern on a small-sized game card.

The user-friendly aspects of the present invention further include the manner in which the potential athlete performances are represented. For example, in the case of baseball, while the abbreviations 1B, 2B, 3B, HR, BB, . . . are used to designate a one base hit (single), two base hit (double), three base hit (triple), four base hit (home run), . . . . the numbers 1–9 are also used to represent the nine potential batting performances designated in each playing area 28*a*–28*i*. Thus, a one base hit (single) through a four base hit (home run) are represented by the numbers 1–4, while a walk is represented by the number 5 and a sacrifice is represented by the number 6. Use of these numbers to represent these particular batting performances is logical and easily memorable. Thus, contestants need not commit to memory any complicated rules or symbols in order to play the inventive game and contestants need only memorize or refer to a legend printed on a game card to determine the batting performances associated with the numbers 7–9. Since numeral 7 merely designates a strike out, numeral 8 designates a fly out and numeral 9 designates a ground out, committing these numbers and their associated batting performances to memory requires very little thought. As described in greater detail below, the use of numerals 1–9 to represent each of the potential batting performances simplifies computer card validation when a telephone keypad or voice recognition system is used for entry of contestants' predictions to a central validation computer.

As noted above, prior to the beginning of the game, the contestants must predict a batting performance for each of the ball players on a respective team designated by the individual playing areas 28*a*–28*i*. Accordingly, only one selection will be made in each playing area 28*a*–28*i* on the playing grid 28, which selection will signify the contestant's prediction for a single at-bat for each of the ball players on a respective team throughout the entire game. If a pinch hitter bats for a player, he is considered as batting for that position regardless of the pinch hitter's actual fielding position.

In accordance with the broader aspects of the sweepstakes game, a winning game card may result when the marking areas of the playing grid 28 which have been accurately selected or predicted form a predetermined geometric pattern along adjacent ones of the playing areas or sections during the course of the contemporaneously played baseball game. Since the playing grid 28 is arranged in the nature of a conventional tic-tac-toe board, the winning geometric patterns are preferably the same as those in a tic-tac-toe game. These winning patterns are illustrated graphically by boxes 40*a*–40*h* on the game card 10.

As noted above, the game card 10 illustrated in FIG. 1 further includes printed indicia 12 resembling a plurality of billboards as they might appear in a typical ballpark. In particular, eight billboards 12*a*–12*h* are provided around the periphery of the playing areas 28*a*–28*i* of the playing grid 28 representing the outfield of the baseball field.

The billboards 12*a*–12*h* are arranged such that a single billboard is printed in an in-line relationship with each of the three rows 16, 18, 20 and three columns 22, 24, 26 of the playing grid 28. Additionally, respective billboards 12*a* and 12*h* are provided in-line with the two sets of diagonal playing areas (28*a*, 28*e*, 28*i* and 28*c*, 28*e*, 28*g*).

In addition to illustrating the winning patterns of correctly predicted batting performances along with pattern indicia 40a–40h, the billboards 12a–12h provided on the game card 10 will reveal the prizes associated with each of the winning geometric patterns. Thus, by way of example, billboard 12a represents the prize associated with correct predictions in boxes 28a, 28e and 28i of the playing grid 28, as illustrated graphically by pattern 40a. Similarly, billboard 12b represents the prize associated with correct predictions in boxes 28a, 28d and 28g of the playing grid 28, as illustrated graphically by pattern 40b. In a like manner, pattern 40c represents the winning geometric pattern associated with billboard 12c and playing areas 28b, 28e and 28h, pattern 40d represents the winning geometric pattern associated with billboard 12d and playing areas 28c, 28f, and 28i, pattern 40e represents the winning geometric pattern associated with billboard 12e and playing areas 28c, 28e and 28g, pattern 40f represents the winning geometric pattern associated with billboard 12f and playing areas 28a, 28b and 28c, pattern 40g represents the winning geometric pattern associated with billboard 12g and playing areas 28d, 28e, and 28f, and pattern 40h represents the winning geometric pattern associated with billboard 12h and playing areas 28g, 28h and 28i.

Just as in any bingo game, one competes against any number of other contestants for various prizes. The prizes can vary according to the number of contestants playing the game. While knowledge of individual player statistics serves to increase the chances of winning, any contestant, whether highly knowledgeable about the game of baseball or having little knowledge of the game can play the sweepstakes game of the present invention. By rewarding contestants for their correct predictions, the game will serve to enhance spectator interest and will facilitate an increased level of study and interest in the game. By determining winning contestants at the end of the baseball game, the sweepstakes-type game of the present invention will serve to enhance spectator interest even in those games in which the home or favorite team is far behind the visiting team. Moreover, involvement in the sweepstakes game will interest those who were previously disinterested in the game of baseball, and will become a catalyst to increase their knowledge of the players and their abilities, as well as the batting rotations.

The sweepstakes game of the present embodiment is unlike a typical game of bingo since the individual playing areas 28a–28i permit contestants to predict the batting performance of each player on a respective baseball team. As will be appreciated, certain batting performances are more common than others, and others are more difficult to achieve. Unlike the game of bingo, in which contestants' game cards are merely filled in as numbers are retrieved from a hopper and called out, contestants in the sweepstakes game of the present embodiment predict, in advance, the batting performance of selected ball players on a given team, and the outcome of the game determines the winning contestants.

As shown at reference numeral 34, the game card 10 is further provided with an individual score card 34 in each of the playing areas 28a–28i. Thus, by way of example, contestants may keep track of the performance of each player using the score card 34 associated with the respective player. In another mode of play, however, the score cards 34 are used to make additional predictions of the performance of each player at each time at bat throughout an entire ball game.

If desired, point values may be assigned for each of the enumerated batting performances. The point values are selected from lowest to the highest value in accordance with the probability of each respective enumerated batting performance, which is determined, for example, by the frequency of each batting performance actually occurring during one or more baseball seasons. Thus, the point value of either a "ground out" or "fly out" is the lowest because these plays occur most frequently during a baseball game. On the other hand, the point value for a "triple" is the highest due to its infrequency. All the other batting performances fall within those high and low point values according to their actual probabilities.

Figure 2:
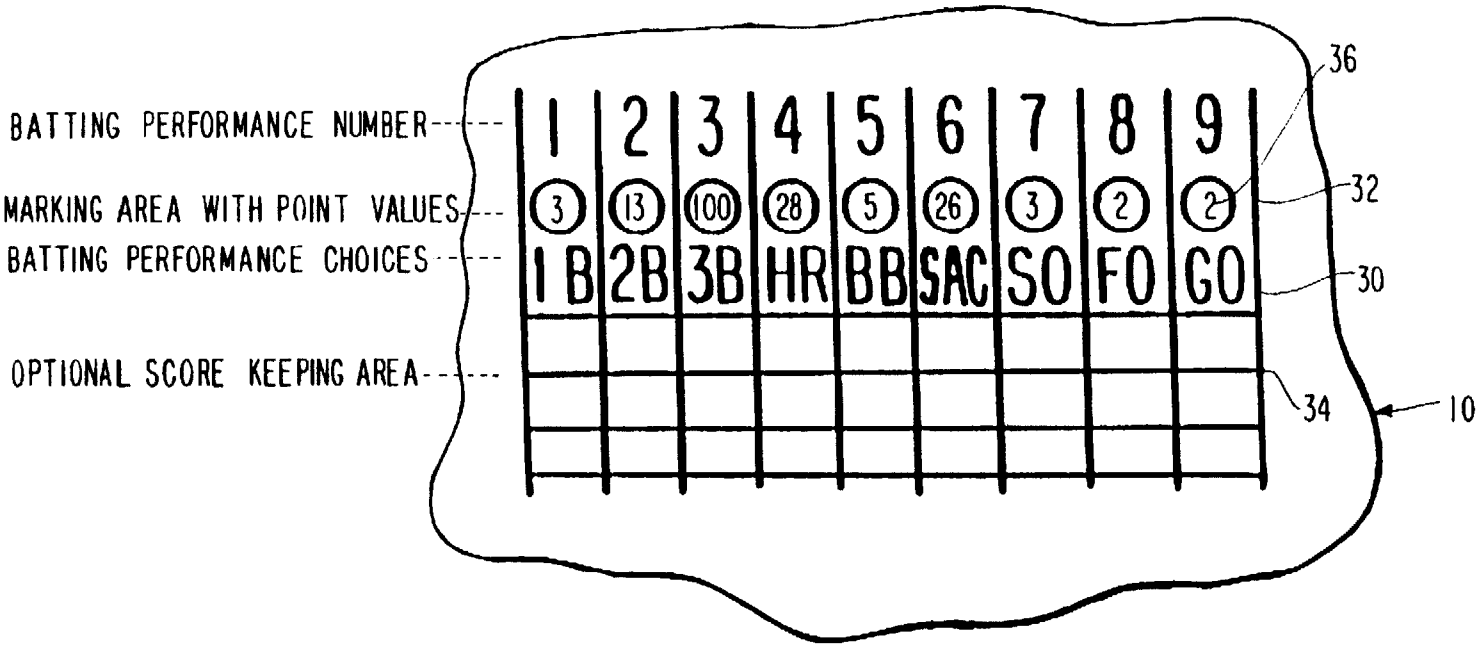
FIG. 2 shows a variation of the indicia printed within each of the playing areas shown in FIG. 1.

For example, the following point values may be assigned for each of the nine enumerated batting performances:

1B (One base hit) (Single)—3 Points 2B (Two base hit) (Double)—13 Points 3B (Three base hit) (Triple)—100 Points HR (Four base hit) (Home Run)—28 Points BB (Base-on-Balls) (Walk)—5 Points SAC (Sacrifice bunt or Sacrifice fly)—26 Points SO (Strike Out)—3 Points FO (Fly Out; or fly ball error or fielder's choice fly out)—2 Points GO (Ground Out; or ground ball error or fielder's choice ground out)—2 Points Referring to FIG. 2, a modified version of the indicia imprinted within each of the respective playing areas 28a–28i is shown. The second printed indicia 30, marking areas 32 and score card 34 are identical to those shown in each playing area of FIG. 1. In addition to these features, however, the point values discussed above are also imprinted. Thus, each potential batting performance is represented by a numeral (1–9), an abbreviation (1B, 2B, 3B, HR, BB, SAC, FO, GO) and an associated point value, denoted generally in the drawing by reference numeral 36.

Figure 3:
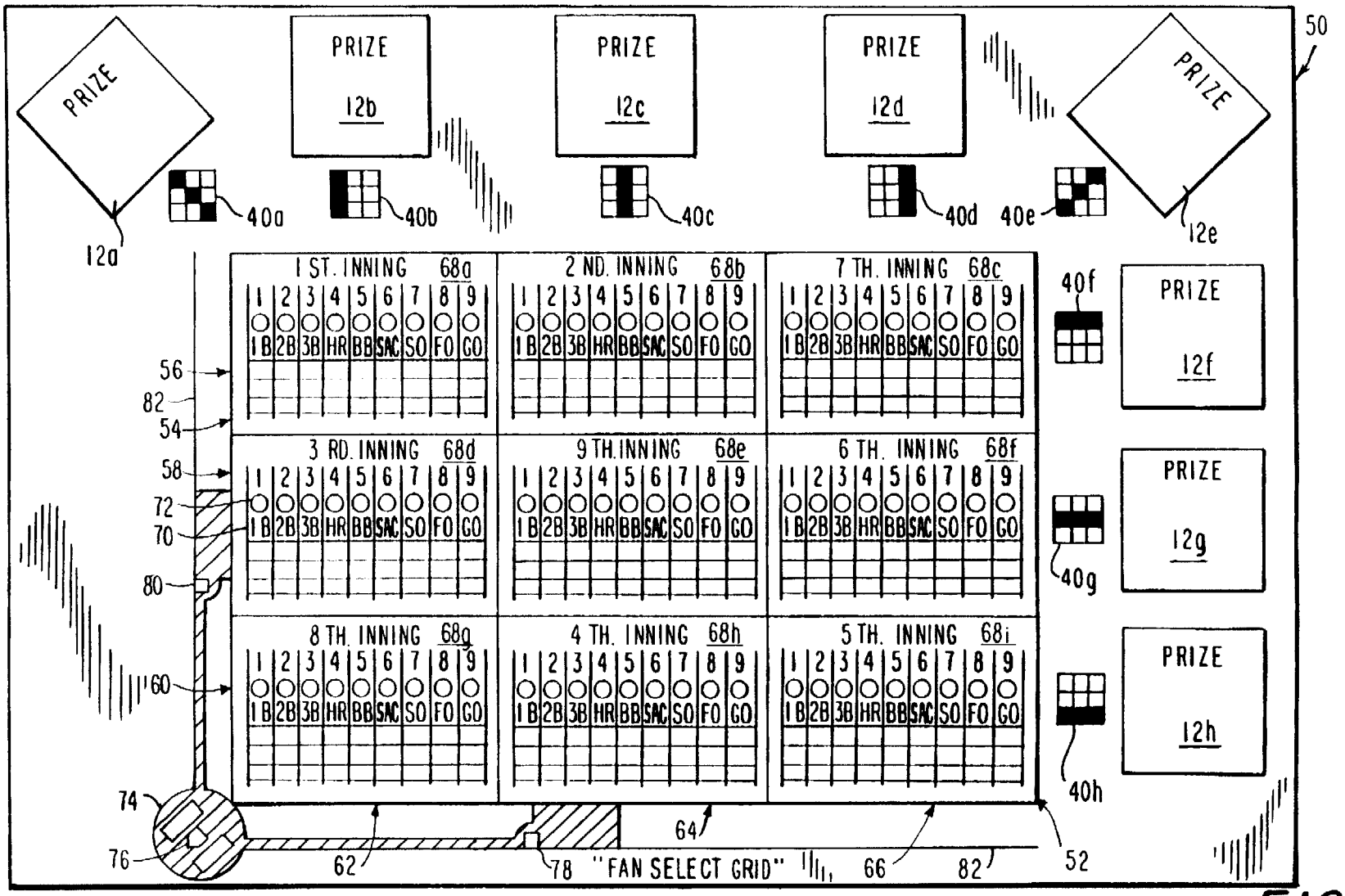
FIG. 3 shows a game card in accordance with a second embodiment of the present invention, in which the game is also embodied as a baseball sweepstakes game and differs from the embodiment shown in FIG. 1 in that the playing areas are each arranged to define individual innings in a baseball game.

Referring now to FIG. 3, the design of a modified game card 50 having a playing grid 52 in accordance with a second embodiment of the present invention will be described. In accordance with the second embodiment illustrated in FIG. 3, the grid 52 includes printed indicia 54 forming three rows 56, 58, and 60, and three columns 62, 64, and 66 defining a plurality of playing areas 68a–68i similar to the first embodiment. Rather than being arranged to correspond to individual fielding positions, however, the individual playing areas 68a–68i of the grid 52 each represent a separate inning of an on-going baseball game in conjunction with which the sweepstakes game is played. Within each of the individual playing areas, second indicia 70 and marking areas 72 are provided which are similar in appearance and use to those illustrated in FIG. 1.

Since the modified playing grid 52 is not arranged to resemble a typical baseball field, the printed indicia representing the infield and outfield of a ball field shown in FIG. 1 is omitted. Instead, field indicia 74 is provided around the lower periphery of the playing grid 52 to resemble the periphery of a typical a baseball field, including home plate 76, first base 78, third base 80, and foul lines 82. Billboards 12a–12h and pattern indicia 40a–40h are also provided, and are identical in appearance and function to the same elements illustrated in FIG. 1.

As will be readily understood, each contestant will make one batting performance prediction in a marking area 72 for each inning of the ball game represented by playing areas 68a–68i of the modified playing grid 52. Point values and geometric arrangements of winning combinations are the same as in the first embodiment. Similarly, winning contestants are determined at the end of the baseball game.

Figure 4:
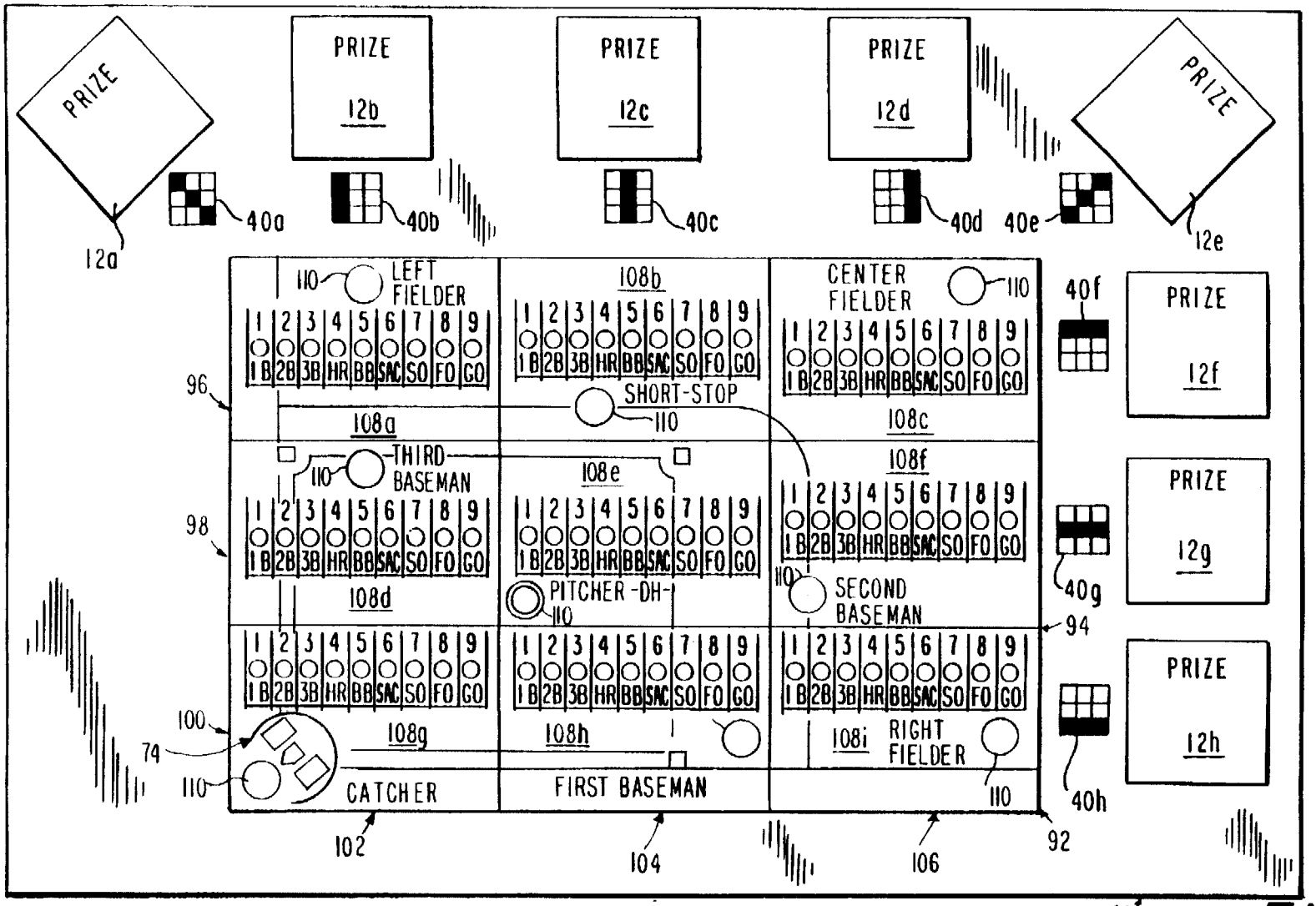
FIG. 4 is an illustration of a game card in accordance with a third embodiment of the invention, in which each of the nine playing areas represents a different player position.

Referring now to FIG. 4, the design of a modified game card 90 having a playing grid 92 in accordance with a third embodiment is shown. The same game as well as the same variations or modifications thereof above described may similarly be used in connection with the game card 90. The playing grid 92 includes printed indica 94 forming three rows 96, 98 and 100, and three columns 102, 104 and 106 defining a matrix of playing areas 108*a*–108*i* similar to the first and second embodiments. While the playing grid 92 is somewhat different from the playing grid illustrated in FIGS. 1 and 3, as is each of the respective playing areas or sections 108*a*–108*i*, the indicia representing the playing field is preferably drawn so that the various field players are arranged in their respective boxes, as in the case of the game card 10 shown in FIG. 1. A few additional minor modifications are shown. For example, instead of using drawings of actual ball players, each playing area is labeled with the name of the respective playing position and is provided with a circular area 110. In addition, rather than illustrating a ball field as seen from the stands behind home plate, the game card includes printed indicia representing a topographical view of a ball field.

In each of the foregoing embodiments, the game card is suitable for use on a cathode ray tube ("CRT") of a computer, where marking selection may be made by electronic pen or use of a touch-sensitive screen. Once the selections have been made, a ticket or card may be optionally printed and dispensed with the selected choice. Of course, in the preferred embodiments described above, a similar ticket, card or coupon can be printed out after the marked-up cards prepared by contestants are scanned in using the optical card readers.

Figure 5:
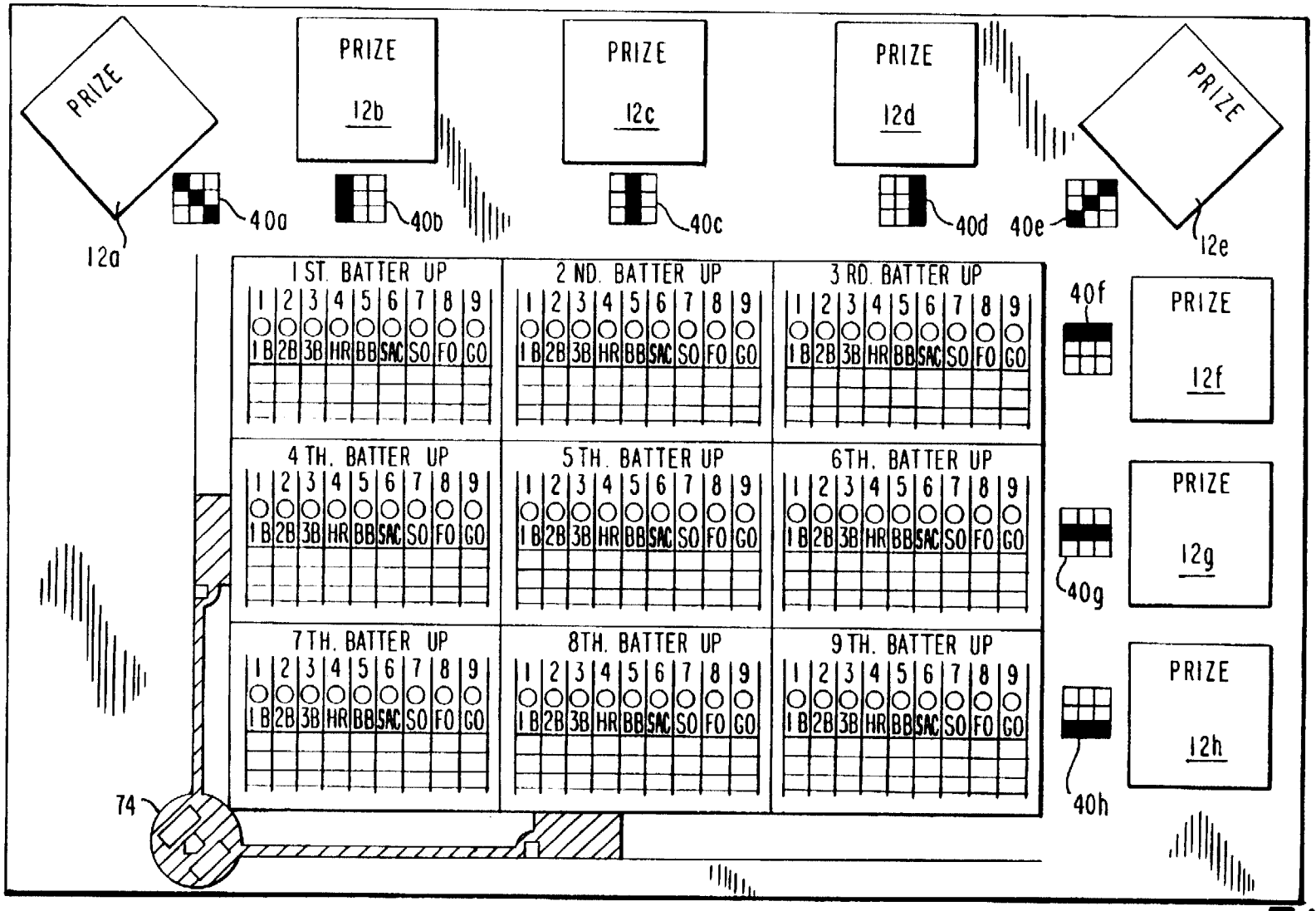
FIG. 5 is an illustration of a game card in accordance with a fourth embodiment of the invention, in which each of the nine playing areas represents a different batter in a team's rotation.
Figure 6:
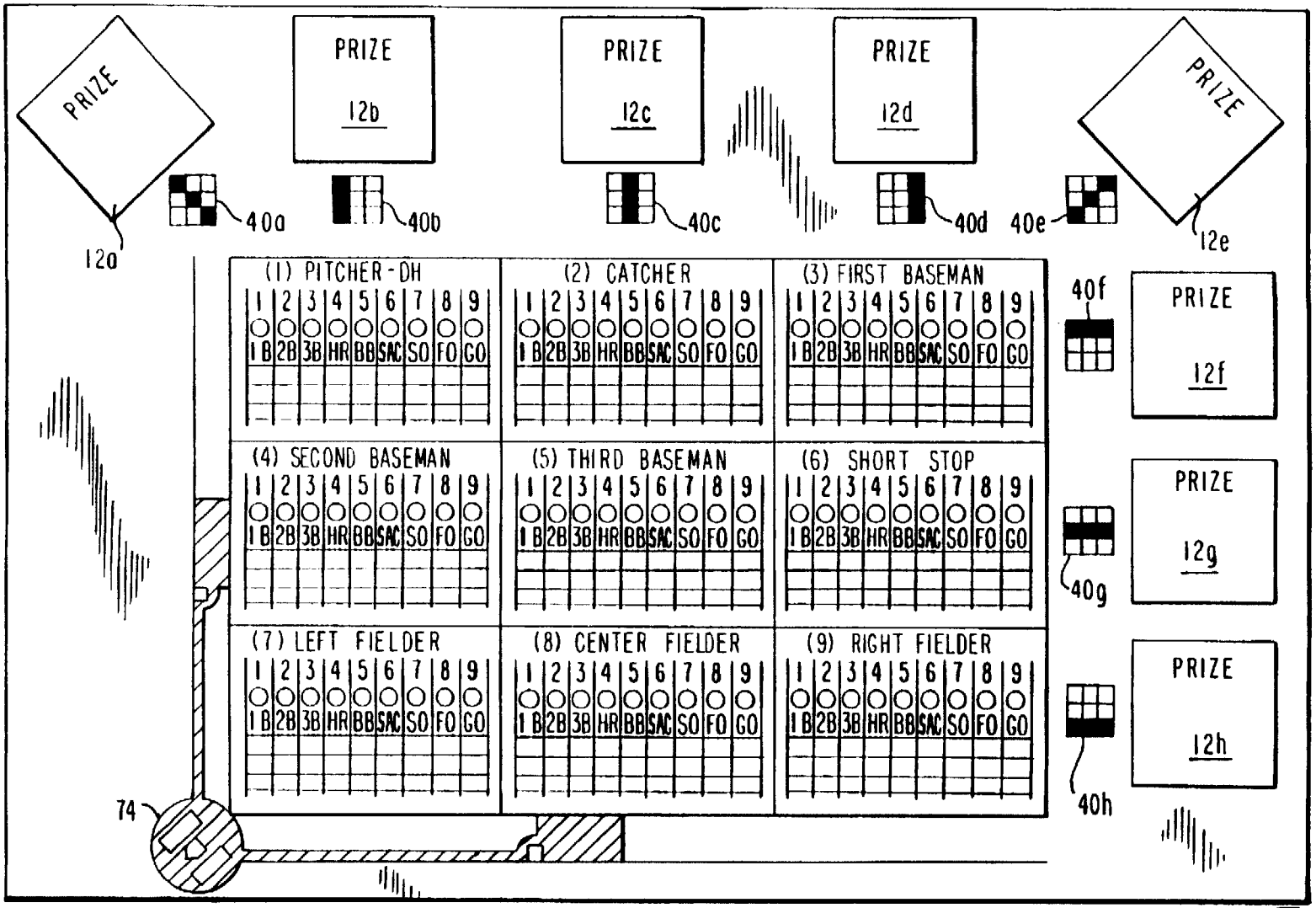
FIG. 6 is an illustration of a game card in accordance with a fifth embodiment of the invention, in which each of the nine playing areas represent a different player position.

FIGS. 5 and 6 illustrate modified game cards. In FIG. 5, the playing areas are each assigned to represent a different batter in the batting rotation of a respective team. In FIG. 6, the playing areas are each assigned to represent a different ball player, however, unlike the game card 10 shown in FIG. 1, the players are represented by the position number which designates their position.

As will be appreciated, any other arrangement of the playing areas and marking areas may be used for a given or particular card reader or computer reading hardware. Computerized bingo-type games and computer-based reading devices per se are already known and the technology for implementing the instant game by way of computer would readily be known to one skilled in the art. Examples of computer games of the type under discussion include those disclosed in U.S. Pat. Nos. 4,312,511 to Jullien; 4,661,906 to DiFransesco, et al.; 4,768,151 to Birenbaum, et al.; 4,863,173 to Chen; 4,875,686 to Timms; and 5,072,381 to Richardson, et al.

Figure 7:
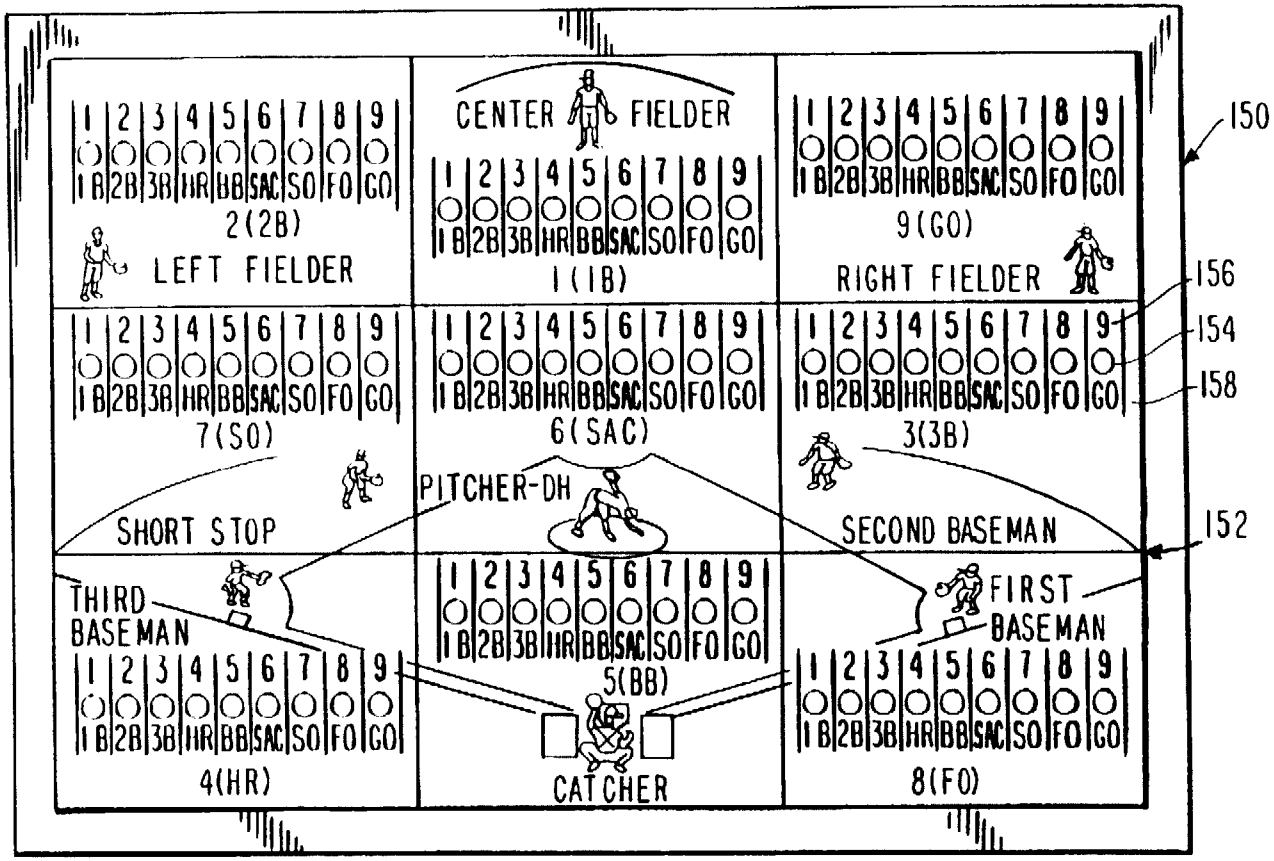
FIG. 7 is an illustration of a playing grid in a sixth embodiment in which predictions are preselected for a contestant.

FIG. 7 depicts a game card 150 having a grid 152 arranged in three rows and three columns as described above. Individual players are depicted in the nine playing areas, together with marking areas 154, performance numbers 156 and performance choices 158, as described above in connection with FIG. 2. In a variant embodiment, rather than having the human participant predict the performance of the individual players, a computer preselects the performances and displays these choices to the human participant on a grid printed on the card 150, typically on the reverse side thereof.

Figure 8A:
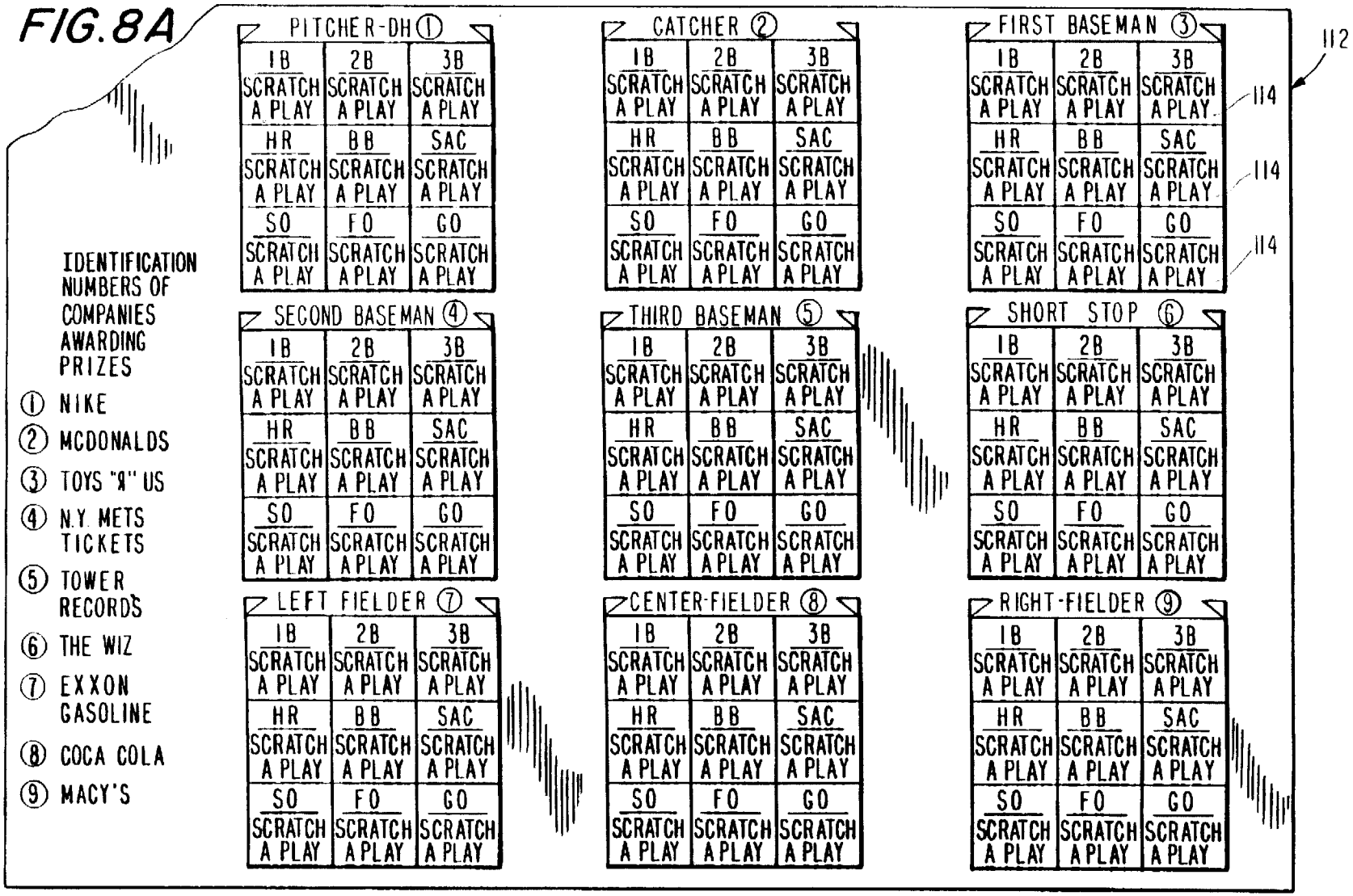
FIGS. 8A and 8B illustrate a seventh embodiment of the present invention in which the sweepstakes game is designed as a game of chance in which contestants remove scratch-off pads corresponding to the batting performance of individual players throughout a baseball game.
Figure 8B:
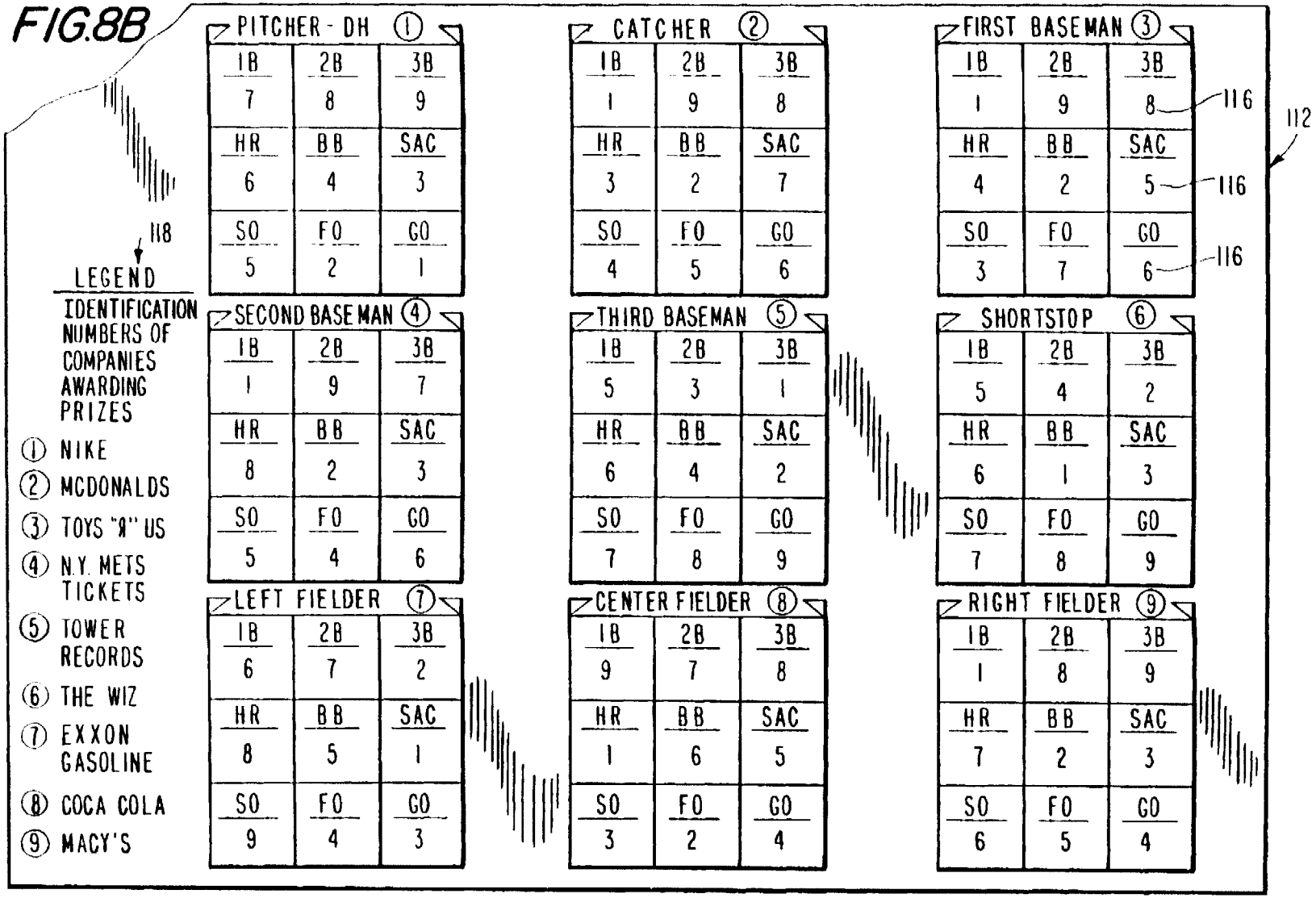

In another embodiment of the invention described in reference to FIGS. 8A and 8B, however, the contestants need not make batting performance predictions and the preprinted game card 112 includes scratch-off pads 114 screen-printed over "hidden" prizes. In this embodiment, as a baseball game progresses, the contestant removes scratch-pads 114 corresponding to the ball players' actual batting performances.

For example, when the left fielder hits a home run, the contestants will manually remove the scratch-off pad corresponding to the "home run" selection in the left fielder square. Similarly, if the left fielder is up at bat and hits a single, the contestants will remove the scratch-off pad corresponding to the "single" selection in the left fielder square.

At the conclusion of the game, winners of the game are determined by a given geometric pattern of matching prizes in the manner described above, or based upon the number of so-called matching prizes, and/or associated point values. FIG. 8A illustrates the game card 112 in the manner it would appear when presented to contestants. FIG. 8B illustrates one game card 112 without the scratch-pads applied. As shown, prize revealing indicia 116 is imprinted in each playing area to represent a number associated with a respective sweepstakes prize. Different cards have different indicia 116. A legend 118 is provided on each card 112 to indicate the identity of the various sweepstakes prizes.

As the baseball game has progressed and the contestants have been engaged in removing the appropriate scratch-off pads which are associated with the players' batting performances, the identity of various prizes will be revealed. The particular prizes which are awarded to winning contestants may be determined based upon the frequency of particular prizes, or, in the manner described above, upon particular geometric patterns of matching prizes or associated point values.

In connection with the game of baseball, in which nine field positions are represented by nine playing areas on the game card, the latter means of sweepstakes identification it is most advantageous since prize identity can be revealed in the nature of a tic-tac-toe game.

As each fielder has had an up at bat, the contestants may choose to remove the scratch-off pad corresponding to that up at bat, or may wait until the end of the game to make his or her selection of a particular up at bat for each fielder in order to increase the likelihood of winning.

Figure 9A:
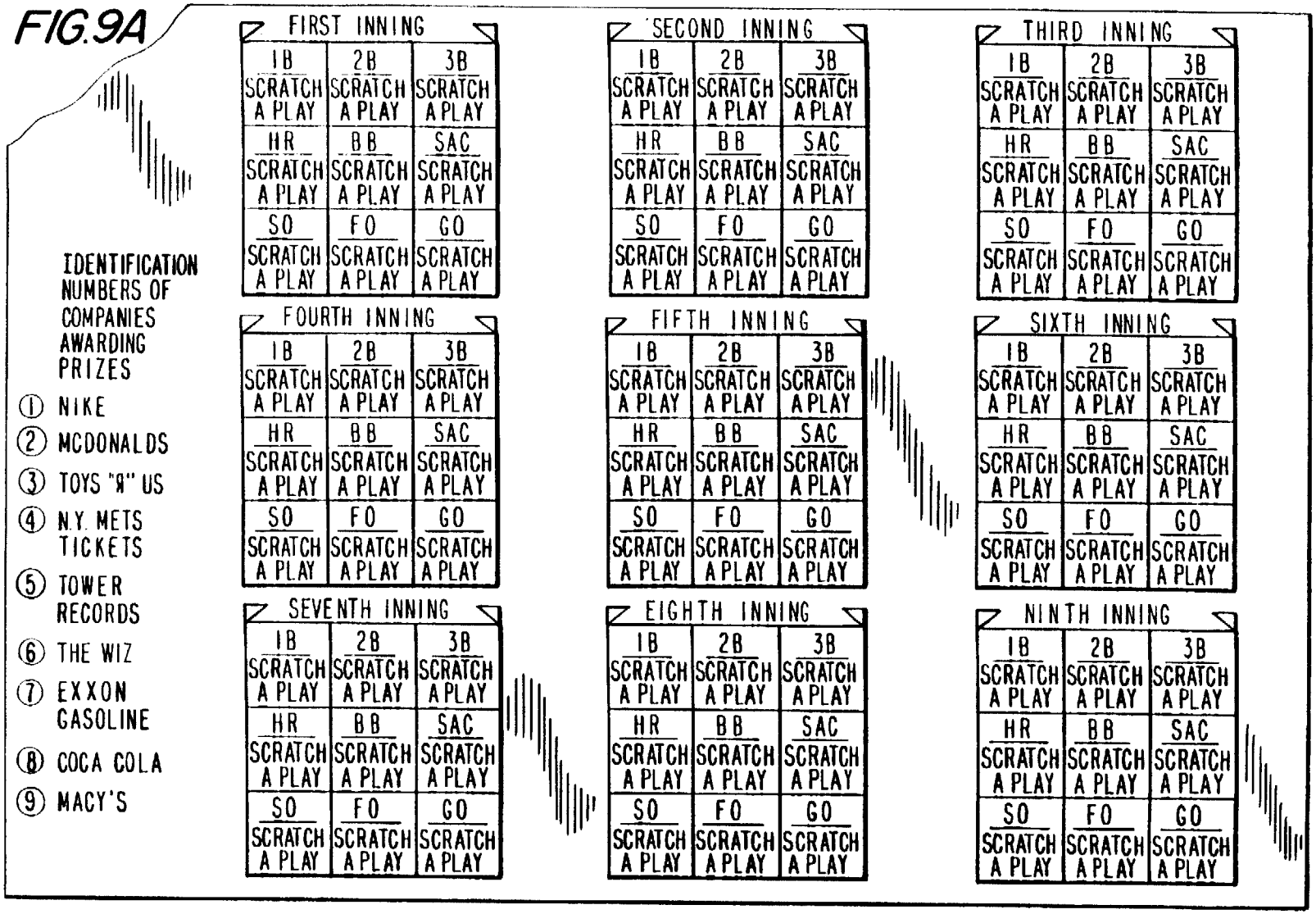
FIGS. 9A and 9B illustrate a variation of the seventh embodiment in which the playing areas are arranged to define individual innings in a baseball game.
Figure 9B:
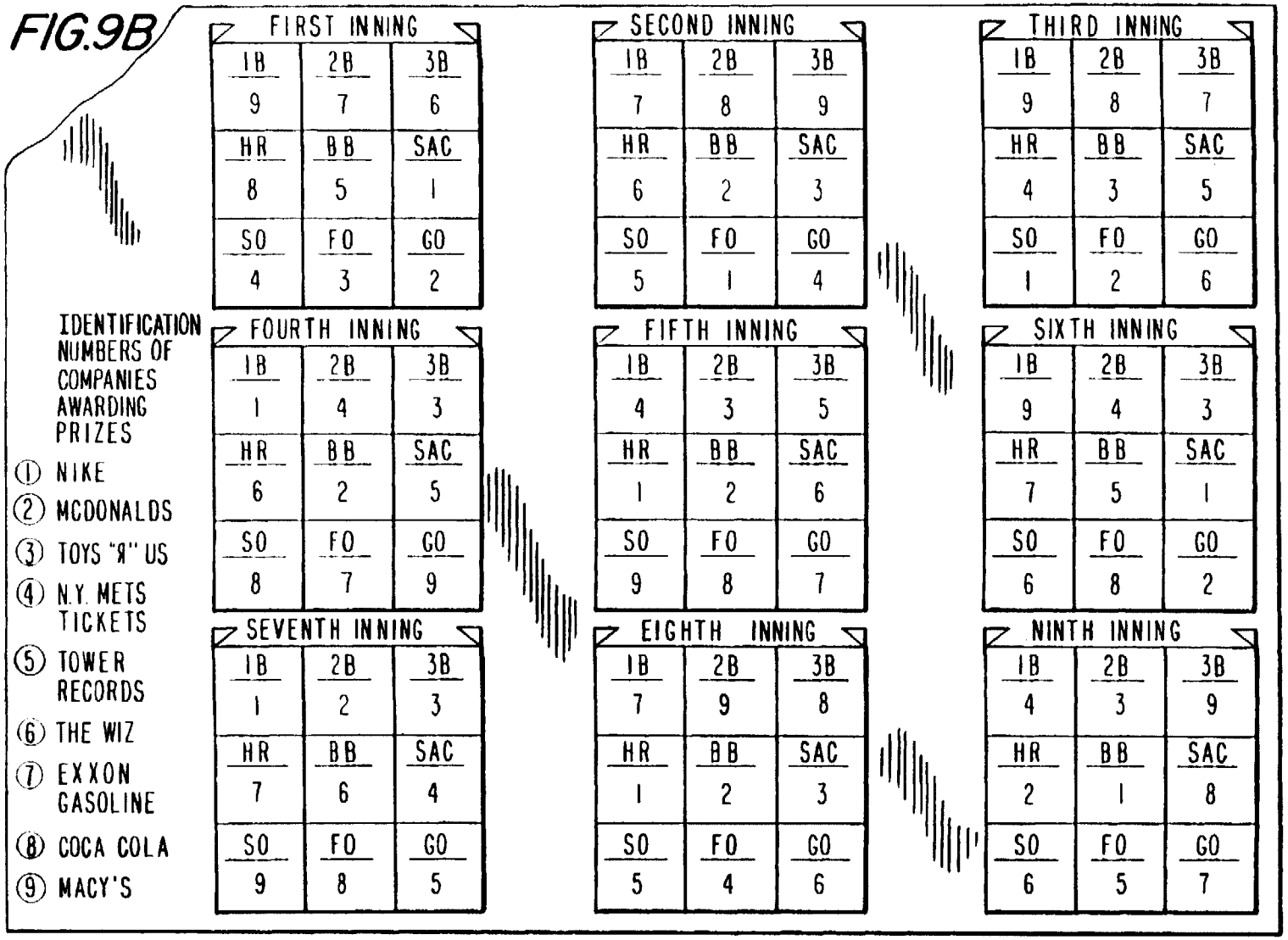

FIGS. 9A and 9B illustrate another embodiment of the inventive game. Similar to the game illustrated in FIGS. 8A and 8B, this embodiment is significantly different from the previous embodiments, in that the game is configured as a game of pure chance and winning contestants are not determined based upon their selection of players' batting performances.

Various modes of play will now be described. When the sweepstakes game is to be played in a baseball stadium or commercial outlet, individual game cards are to be distributed to each contestant. In such case, game cards having marking areas designed to be shaded in by contestants facilitate an effective manner to keep track of all entries. In that case, all game cards and batting performance predictions are entered into a monitoring computer through the use of card scanners for scanning all contestants' game cards. An embodiment of such a system will be described below.

The preferred name for the sweepstakes game which will use the apparatus which is the subject of this invention is "BASEBALL BINGO". In accordance with a preferred mode of use of the present invention, the sweepstakes game is sponsored as a part of a program for marketing one or more products or services. For example, with the purchase of a particular item, such as a newspaper or periodical, or a visit to a particular retail outlet or fast food restaurant, a customer or potential customer would receive a game card with which he or she could play the BASEBALL BINGO sweepstakes game. In accordance with another preferred mode of use, the sweepstakes game is designed to be played in a ballpark in conjunction with an on-going game of baseball and game cards, such as those shown in FIG. 1, are distributed at a baseball stadium to spectators of the baseball game. Of course, the game of BASEBALL BINGO can be played concurrently by spectators at a baseball stadium, patrons at commercial establishments or retail outlets, or individuals at home. The sponsor of BASEBALL BINGO dictates the particular mode of play adopted.

When played in a stadium in connection with a particular baseball game, spectators may enhance their odds of winning the sweepstakes by use of a program which provides the identity and individual playing statistics of the baseball players in the baseball game which is the subject of a particular BASEBALL BINGO sweepstakes.

Preferably, for each baseball game in connection with which BASEBALL BINGO is played, outside sponsors, such as commercial vendors, fast food restaurants, and the like, will also make available to contestants a list of the baseball players and their playing statistics that are expected to participate in the baseball game.

As noted above, the object of the game is for the contestants to predict at least one at-bat performance of some or each of the players on a selected team during the baseball game. The contestants will use the marking areas 32 provided on the game card to record his or her predictions.

The game card illustrated in FIG. 1 is in a form designed for use in automatic computer controlled equipment of the type made by Scantron Corporation of Tustin, Calif. This particular game card comprises a nine digit access number 200 which is pre-printed on the card to provide up to one billion uniquely numbered game cards for each baseball game. It also comprises a pre-printed six digit game number 202 to identify the particular baseball game. This will enable coverage of all baseball games played within a particular season by the sweepstakes game. A two digit number shown at reference numeral 204 identifies the calendar season of the baseball game. All of this information is pre-printed on all of the game cards prior to distribution for customer participation.

As discussed above, the game cards are distributed to spectators at a baseball game, sold in retail outlets in which other lottery-type games are sold, and/or distributed to customers or potential customers in connection with a specific marketing program. Participating contestants are instructed by the game card to predict the batting performance of the baseball players on a particular team during a specific baseball game. On the game card illustrated in FIG. 1 there are provided marking areas 32 which correspond to a number of enumerated batting performances, one of which may be selected by contestants for each playing area 28*a*–28*i*. The batting performance predictions are indicated by shading the respective marking areas 32 in each of the nine playing areas 28*a*–28*i*.

The game card 10 of FIG. 1 comes pre-printed with an access number 200, the game designation number 202 and the year 204. The game card 10 illustrated in FIG. 1 shows a pre-printed access number of 123,456,789. The game card 10 is marked 16 to correspond to a game between the New York Mets and the Montreal Expos and 96 to represent calendar year 1996.

While the game card 10 is illustrated as having a pre-printed game number 202, this number need not be provided on the card 10. In that case, the contestants are instructed to shade in the number of the game from a predetermined numbered list of professional baseball games. The year can either be pre-marked with a year designation number 204 or left for the participant to mark in a similar fashion. A completed game card 10 is then taken to a card reader which may be preferably located in a ball park or at the location of a sponsor, such as a fast food restaurant, and the participant's prediction is recorded by inserting the card into a card reader, where it is read automatically and the information is stored by a computer in a form such that the information can be readily recalled by a computer processor. If a card reader facility is not located near the contestant, or if access to one is inconvenient, the rules could permit the contestant to mail his or her card to a reader location. There are numerous commercially available card readers of various complexities and capabilities. A card reader adequate for use at individual sponsors' facilities is the Scantron Model 1300 Optical Mark Reader/Data Terminal. This commercially available card reader system retails for approximately $2,000 and operates with a wide variety of personal computers.

On the other hand, for a central validation center processing hundreds of thousands of coupons, a high speed card reader is required. For this purpose, a Scantron System 9000, or the like, could be used. (Equipment similar to the Scantron equipment is available from National Computer Systems of Minneapolis, Minn.). In order to implement a nationwide sweepstakes game, all of the card readers at individual sponsor locations would be tied together to a central computer. Throughout the course of a baseball game which is the subject of a given sweepstakes, the individual batting performances of the respective players are input into the computer. The computer is pre-programmed to determine the winner or winners of the sweepstakes from the pre-scanned game cards, which should require only a few seconds. Thus, it is possible to announce the winning access number or numbers to an audience immediately at the end of a game, as the ball players are walking off the field. Or if desired, the name or names of the sweepstakes winner or winners could be announced. On the other hand, winners need not be announced at all, and contestants could redeem their prizes at validation centers.

An alternate method of data entry is available using the keypad of a conventional dual tone multi-frequency ("DTMF"), or TOUCH TONE telephone. Actually the only critical item on the game card for use in this case is the access number 200. In this case the access number is 123,456,789. The game card should also provide a telephone number 206 for the contestants to call his or her predictions in to a central validation center. The telephone number will preferably be a local number or a toll free long distance (800 type) number when this invention is used as a part of an advertising plan. However, when used as a part of a sweepstakes game for profit, a fee could be charged through the telephone company by using a fee-type telephone number. The remaining information on the game card shown in FIG. 1 is merely provided to assist the contestant in transmitting his or her predictions and to serve as a record of the predictions. The participant writes his or her batting performance predictions (and other requested information described above) into the proper blank marking areas 32 on the game card 10.

In this case, the game card 10 instructs the contestant to call in his or her batting performance predictions, for example, to the telephone number (800) 555-1234. A processing system including a computer controlled telephone answering device is provided at that number. The system is preferably programmed to answer the telephone, and to instruct the participant calling to type his or her access number followed by the contestant's batting performance predictions and any other needed information into the contestant's telephone keypad. The system is further programmed to record the information provided by the contestant and to inform the contestant if the information provided is not in the correct form. Additionally, the system can also inform the contestant that his or her access number is not valid, or has already been used.

Figure 10A:
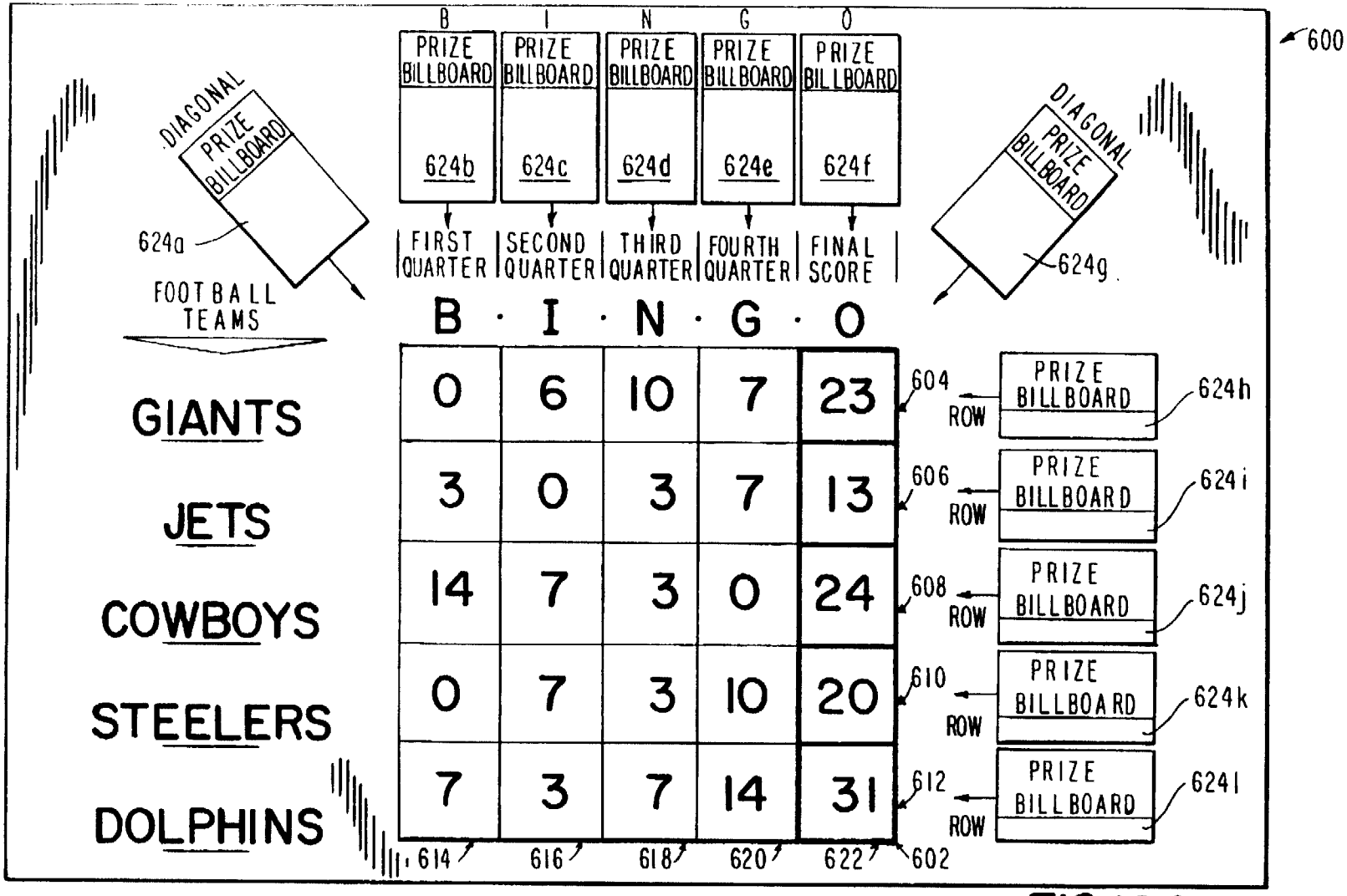
FIG. 10A is an illustration of a game card in an eighth embodiment of the present invention in which the game is a football sweepstakes game and the individual playing areas are arranged to define the four individual quarters of a football game.

FIG. 10A illustrates a game card 600 in which the game is a football sweepstakes game, and has a grid 602 arranged in multiple rows 604, 606, 608, 610 and 612 and multiple columns 614, 616, 618, 620 and 622 to define the four individual quarters of a football game and the final score. Indicia within the playing areas indicate potential scores for various football teams in each quarter. A player predicts the score for a particular team for a particular quarter in advance, and the results are subsequently compared to the predicted scores. Prizes in billboard areas 624*a*–624*l* are awarded as described previously for reference numerals 12*a*–12*h*.

Figure 10B:
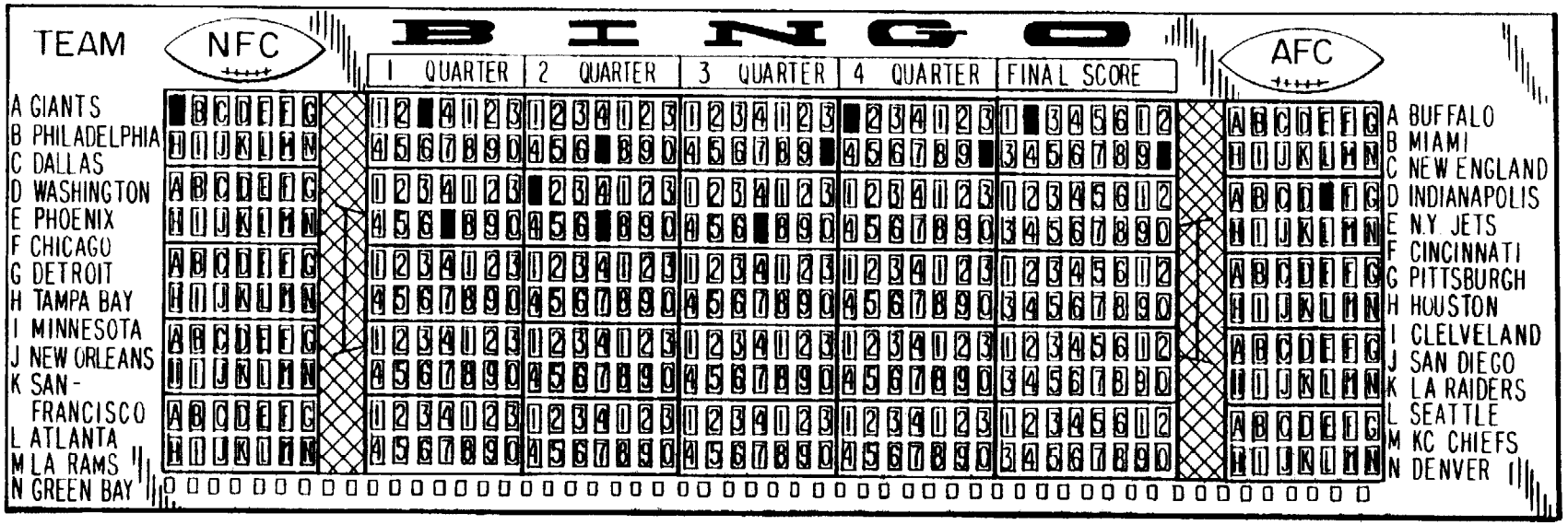
FIG. 10B is a variation of the game card shown in the eighth embodiment of the present invention.

FIG. 10B illustrates a variation of the game card of FIG. 10A, and depicts more football teams, as well as areas to be marked with the predicted scores.

Figure 11:
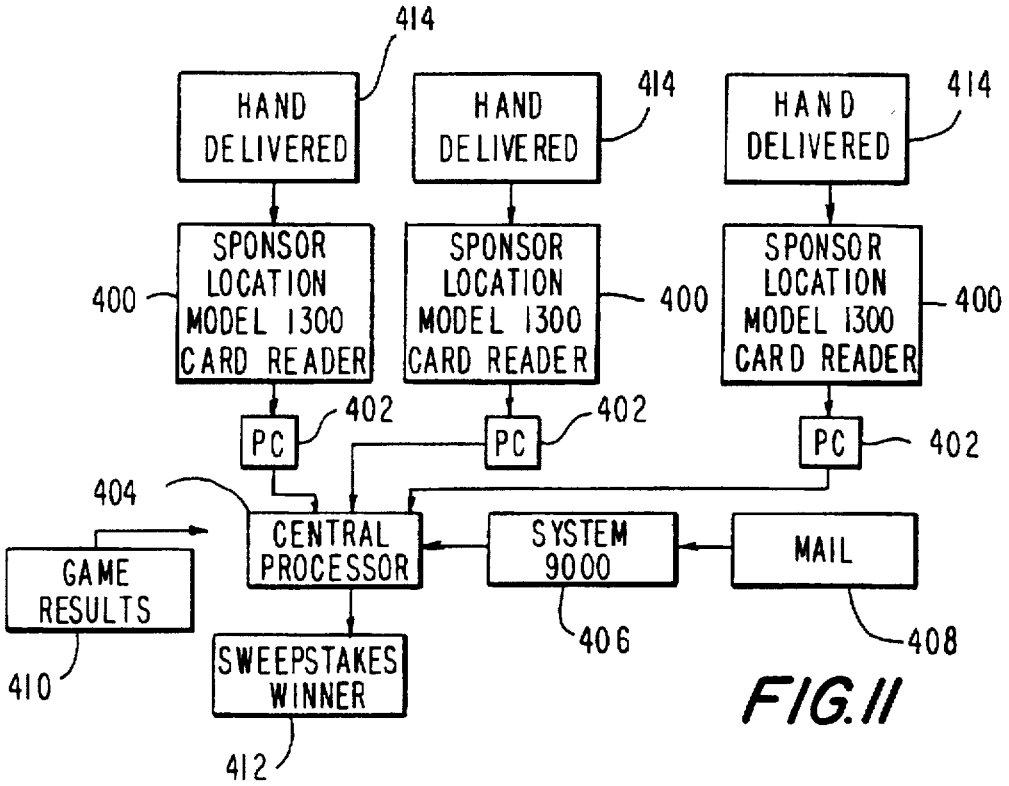
FIG. 11 is a simplified block diagram of the principal components employed for practicing a sweepstakes game in accordance with one aspect of the present invention.

FIG. 11 is a general layout plan for a sweepstakes game using card readers. The cards are hand-delivered (block 414) to a plurality of card readers 400 and computers 402 located at retail outlets throughout the country and are connected by telephone lines or satellite to a central processor 404. The central processor is preferably a high speed, large memory computer. Also connected to the central processor 404 is one or more System 9000 Optical Mark Readers 406 which is located at a central station to read game cards sent in by mail (block 408). Once the baseball game is over, an operator inputs the respective player performances (block 410)into the central processor so that the winning set or sets of numbers are determined (block 412). In order to win, a contestant must correctly predict the batting performances of three ball players in a row or diagonally, as in tic-tac-toe. There could, of course, be many winners. In such a case, the prizes could be kept small, or the winners could share the grand prize. In the absence of any winning contestants, prizes could either be awarded to the best predictions in terms of point values, or carried forward to the next week, as is typical in lottery-type games.

The central processor thus determines the winning combinations of BASEBALL BINGO numbers and then determines the access numbers of the winning players from information previously collected. Preferably, these determinations can be made within a few seconds or minutes after the baseball game is over and as suggested above, the winners can be announced to the television and/or stadium audience while the baseball players are walking off the field. This aspect of the sweepstakes game will vastly increase the interest of the spectators and television audience in professional sports, especially for those participants who have predicted the batting performances and who are still in contention near the end of the game. Thus, even when the home team is far behind the visiting team and cannot win, spectators and viewers will still be interested in the outcome of the game. Using high-speed processing equipment, there should be adequate time for the contestants' predictions to be processed and available in the memory of the central processor at the conclusion of the ball game if the predictions are timely scanned using sponsors' card readers, downloaded to the central validation center and at the central mail station prior to the start of the baseball game.

Figure 12:
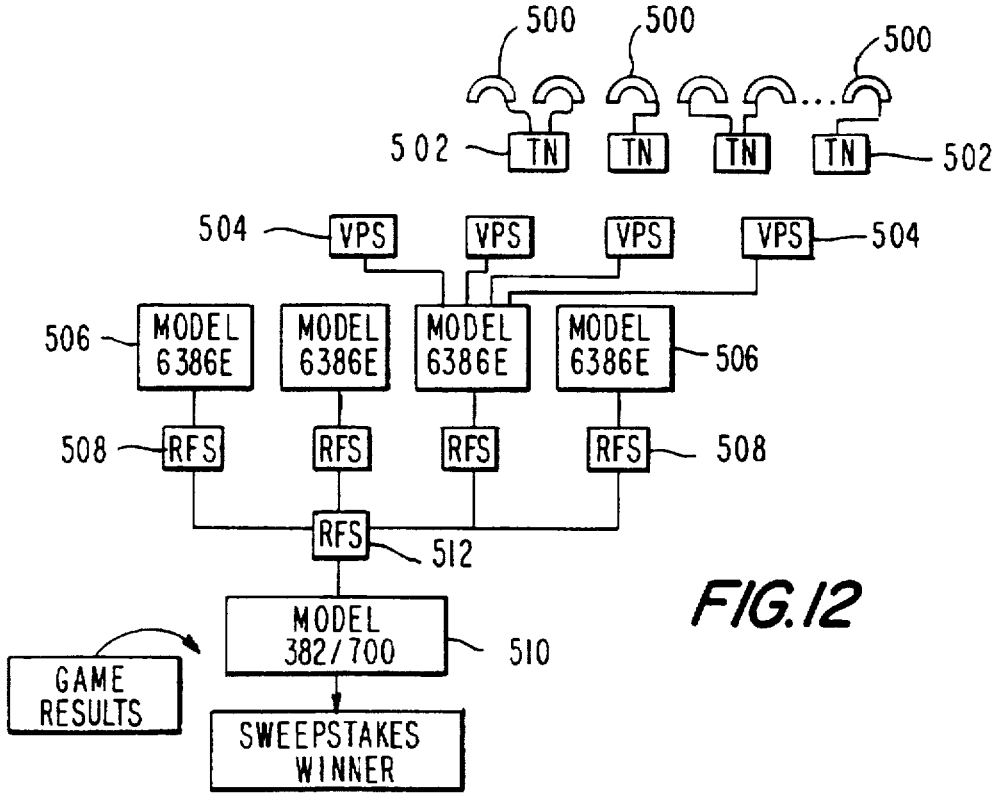
FIG. 12 is a simplified block diagram of the principal components employed for practicing a sweepstakes game in accordance with another aspect of the present invention.

FIG. 12 illustrates a general layout plan for a sweepstakes game using the telephone system discussed above. Preferably, the information is transmitted by many thousands of telephone keypads 500 through telephone networks 502 to a plurality of telephone receiving centers. Each of these receiving centers comprise a voice power board 504, such as an AT&T Model VP4, enabling the receiving center to instruct the contestants on how to transmit his or her batting performance predictions. Four voice power boards are controlled by a receiving computer 506, such as AT&T Model 6386E with a remote file system 508. The Model 6386E receiving computers are connected to a central computer 510 such as an AT&T Model 3B2/700 which also has a remote file system 512 so that it can communicate with a large number of the receiving computers 506. Software for the voice boards is commercially available from software companies such as CIA. Each voice power board can handle four telephone calls simultaneously. An unlimited number of Model 6386E receiving computers can be connected to the central computer and Model 3B2/700 can efficiently handle about 60 to 100 calls simultaneously on a real time basis. More powerful central computers such as AT&T Model 3B4000 can provide increased capacity.

The following is a typical "conversation" between a contestant and a receiving center which takes place prior to the ball game. Assume the receiving centers telephone number is (800) 555-1234, the contestant's access number is 123456789, the contestant predicts the batting performance of the ball players referred to above:

| PLAYER TOUCHES | RECEIVING CENTER SAYS |
|---|---|
| 8005551234 | "Hello. Thank you for playing Baseball Bingo in game 16 between the New York Mets and the Houston Astros. Please press your Access Number." |
| 123456789 | "Thank you. Now press the six digit game number printed on your card." |
| 123456 | "Thank You. Now indicate the team that you are making predictions for by pressing 1 for the Mets and 2 for the Astros." |
| 1 | "Thank You. You're playing for the Mets. Referring to your game card, touch in your batting prediction numbers for the top row of players, now." |
| 139 | "You predicted single for the left fielder, triple for the center fielder, ground out for the right fielder." Touch in your prediction numbers for the middle row of players, now." |
| 672 | "You predicted sacrifice for short stop, strike out for pitcher, double for second baseman." Referring to your game card, touch in your batting numbers for the bottom row of players, now." |
| 845 | "You predicted fly out for the third baseman, home run for the catcher, walk for the first baseman." You are in the game of Baseball Bingo when you hang up. Thank you and good luck." |

It will generally take approximately one minute for this "conversation". Thus, one telephone receiving center could handle up to about 5,000 entries in seven 12-hour days. To handle 500,000 entries, therefore, will require at least about 1,000 receiving centers and on a 16 to 1 ratio about 63 processors. The layout shown in FIG. 11 can be combined with the layout shown in FIG. 12 by tying together the central processor 404 shown in FIG. 11 and the central computer 510 shown in FIG. 12. Alternatively, the two processors could be tied to a third central processor. Preferably, the sweepstakes game will be played on a national and possibly international scale with millions of players and large grand prizes. However, the present invention can also be implemented at a low cost on a very small scale. For example, a single local retailer can sponsor the sweepstakes game for local patrons. In this case, while the prizes may be small, the game can be structured to give the participants a correspondingly better chance of winning. Similarly, on a local scale, the sweepstakes could be implemented without the use of central processors 404 and 510 shown in FIGS. 11 and 12. The equipment needed would be reduced to as few as one card reader 400 and a personal computer 402, as shown in FIG. 11, all of which could be purchased for less than $5000. Alternatively, a single Model 6386E computer 506 and one to four voice power boards 504 as illustrated in FIG. 12 would be adequate. The cost of such a system would be only a few thousand dollars. The cost could be reduced even further by renting the equipment.

There are many ways to determine the winners of the sweepstakes game in addition to the one described above. While it is convenient to utilize geometric patterns in the nature of a tic-tac-toe grid, this is not a critical aspect of the invention. In addition, instead of determining the sweepstakes winner on one predicted batting performance of an entire baseball team, the sweepstakes winner could be based on the results of the batting performance of each batter throughout the entire game during each of their at-bats. As in the above embodiment, this would require that entries would be submitted prior to the start of the ball game.

On the other hand, the sweepstakes game can be based upon the performance of selected players during a single inning of a ball game. In this case, the entries would need to be submitted for validation just prior to the playing of that particular inning. The game could obviously be changed to require the prediction of the batting performance and/or fielding performance of any number of players. Prizes could be awarded on many different criteria. For example, a single grand prize could be offered for the winner with the highest number of points in a point system of the type described below. On the other hand, in addition to a grand prize, prizes of lesser magnitude could be awarded to contestants who predict a certain number of correct batting performances or who receive over a certain score in a point system of the type described below. Greater prizes could be given to those who correctly predict larger numbers of batting performances or who receive greater point values.

Alternatively, as discussed above, all game cards having geometric patterns of correct predictions as illustrated on the game card could be winners of small prizes, while the award of a grand prize is dispensed with. In this case, for example, if a grand prize were to be awarded, it could be based upon other factors.

Some sponsors may want to open the game up to anyone who wants to play. In this case, an access number would not be required. The rules could be changed to require the player to shade in his social security number or his telephone number. Using the social security number might discourage players from submitting more than one entry or engaging in fraud.

As will be appreciated, while the sweepstakes game is preferably played in conjunction with an on-going baseball game, it is not so limited. Previously played games or simulated games (e.g., by computer) can similarly be specifically or randomly selected. In such case, the outcome of such games would determine the winning contestants in the same manner as an on-going game.

Another variation of the game is one in which each of the potential batting performance possibilities is assigned a weighted point value which may be arbitrarily selected or statistically determined based upon the frequency of such plays during many baseball games. Alternatively, the point values may be based, in whole or part, on the past performance of the individual ball players in the particular baseball game. It is noted that a winning card may be determined to be one which first achieves a given geometrical pattern of predicted playing areas or sections. However, instead of just straight line arrangements of areas or sections **28*a*–28*i***, other geometrical patterns may be used, such as squares, crosses, circles, etc. A further variation of the game of the present invention is one in which the winning card is determined by the maximum point value corresponding to the total of all the correct performance possibilities which have been accurately predicted and marked at the end of the game, irrespective of the geometrical patterns of the accurately predicted areas or section. In a still further embodiment or variation of the invention, the aforementioned variations or embodiments may be combined so that only the highest point value of those cards which have achieved a predetermined geometrical pattern becomes the winning cards or where a repeat of the performance predicted occurs during the play of the same game within the same player section adds point values within the section.

It is to be understood that while certain presently preferred forms of the present invention have been illustrated and described herein by way of example, the present invention is not to be limited to the specific form or arrangement of parts described and shown.

I claim:

1. A sweepstakes-type game for play in conjunction with a contest having a plurality of events whose outcomes are unknown prior to their performance, comprising:

means for storing predicted outcomes of the events in advance of their performance;

multiple chance means for earning scoring factors by matching the actual outcomes of the events to correctly predicted stored outcomes, each scoring factor having a plurality of scoring chances to be earned during subsequent performances of individual events during the contest; and means for determining at the end of the contest at least one sweepstakes game winner by obtaining at least one predetermined combination of said scoring factors each earned during any one of its respective scoring chances.

2. The game according to claim 1, wherein the storing means includes a plurality of game cards each having first indicia bounding playing areas each associated with a characteristic of the contest, and second indicia representing a plurality of event outcomes for each characteristic.

3. The game according to claim 2, wherein the contest is a sports contest having individual players, and wherein each characteristic is a respective player's individual identity, and wherein the event outcomes represent the potential performances of the respective player.

4. The game according to claim 3, wherein the player's individual identity is identified by a fielding position.

5. The game according to claim 3, wherein the player's individual identity is identified by a time to perform.

6. The game according to claim 2, wherein the contest is a sports contest conducted in time periods, and wherein each characteristic is a game score compiled during each of said time periods.

7. The game according to claim 2, wherein the playing areas are arranged in a pattern on each game card, and wherein the storing means is operative for marking the predicted outcomes in each playing area, and wherein the predetermined combination of said scoring factors is a geometrical arrangement of said playing areas.

8. The game according to claim 7, wherein the pattern is a plurality of linear rows stacked vertically one above another to form a plurality of linear columns, and wherein the arrangement is a line along one of said rows and columns.

9. The game according to claim 8, wherein the pattern has three of said rows and three of said columns arranged in a grid.

10. The game according to claim 7, wherein the storing means includes marking zones in each playing area.

11. The game according to claim 7, wherein the storing means includes scratch-off overlays overlying each playing area.

12. The game according to claim 7, wherein the determining means includes card readers for electro-optically reading the marked predicted outcomes on the cards, and a processor for comparing the marked predicted outcomes of all the cards with the actual outcomes.

13. The game according to claim 2, wherein the storing means is operative for marking predicted outcomes in each playing area, each outcome having a point value, and wherein the predetermined combination of said scoring factors is total point value.

14. The game according to claim 1, wherein the storing means includes a computer for assigning the predicted outcomes of the events in advance of their performance.

15. The game according to claim 1, wherein the storing means is operative for storing the predicted outcomes by depressing keys on a telephone.

16. A method of playing a sweepstakes-type game in conjunction with a contest having a plurality of events whose outcomes are unknown prior to their performance, comprising the steps of:

predicting outcomes of the events in advance of their performance and storing the predicted outcomes on a storage medium;

earning scoring factors by matching the actual outcomes of the events to correctly predicted stored outcomes, each scoring factor having a plurality of scoring chances to be earned during subsequent performances of individual events during the contest; and determining at the end of the contest at least one sweepstakes game winner by obtaining at least one predetermined combination of said scoring factors each earned during any one of its respective scoring chances.

17. The method according to claim 16, wherein the storing step is performed by providing a plurality of game cards each having first indicia bounding playing areas each associated with a characteristic of the contest, and second indicia representing a plurality of event outcomes for each characteristic.

18. The method according to claim 17, wherein the contest is a sports contest having individual players, and wherein each characteristic is a respective player's individual identity, and wherein the event outcomes represents the potential performance of the respective player.

19. The method according to claim 17, wherein the playing areas are arranged in a pattern on each game card, and wherein the storing step is performed by marking the predicted outcomes in each playing area, and wherein the predetermined combination of said scoring factors is a geometrical arrangement of said playing areas.

20. The method according to claim 19, wherein the determining step is performed by electro-optically reading the marked predicted outcomes on the cards, and comparing the marked predicted outcomes of all the cards with the actual outcomes.

21. The method according to claim 16, wherein the storing step is performed by a computer by assigning the predicted outcomes of the events in advance of their performance.

22. The method according to claim 16, wherein the storing step is performed by storing the predicted outcomes by depressing keys on a telephone.

23. A sweepstakes-type game for play in conjunction with a contest having a plurality of events whose outcomes are unknown prior to their performance, comprising:

a) means for storing predicted outcomes of the events in advance of their performance, said storing means including a plurality of game cards each having first indicia bounding playing areas each associated with a characteristic of the contest, said playing areas being arranged in a pattern on each game card, and second indicia representing a plurality of event outcomes for each characteristic, said storing means being operative for marking the predicted outcomes in each playing area;

b) means for earning scoring factors by matching the actual outcomes of the events to correctly predicted stored outcomes; and c) means for determining at least one sweepstakes game winner by obtaining at least one predetermined combination of said scoring factors arranged in a geometrical arrangement of said playing areas, said determining means including third indicia on each card depicting a plurality of said predetermined combinations, and prize means on each card depicting a plurality of prizes, one for each predetermined combination.

24. A method of playing a sweepstakes-type game in conjunction with a contest having a plurality of events whose outcomes are unknown prior to their performance, comprising the steps of:

a) storing predicted outcomes of the events in advance of their performance by providing a plurality of game cards each having first indicia bounding playing areas arranged in a pattern on each game card, each playing area being associated with a characteristic of the contest, and second indicia representing a plurality of event outcomes for each characteristic, said storing step being performed by marking the predicted outcomes in each playing area;

b) earning scoring factors by matching the actual outcomes of the events to correctly predicted stored outcomes; and c) determining at least one sweepstakes game winner by obtaining at least one predetermined combination of said scoring factors arranged in a geometrical arrangement of said playing areas, said determining step being performed by providing third indicia on each card depicting a plurality of said predetermined combinations, and depicting on each card a plurality of prizes, one for each predetermined combination.

25. A sweepstakes-type game for play in conjunction with a baseball contest having a plurality of events whose outcomes are unknown prior to their performance by individual baseball players, comprising:

a plurality of game cards, each having means for storing predicted outcomes of the events in advance of their performance;

multiple chance means for earning scoring factors by matching the actual outcomes of the events to correctly predicted stored outcomes, each scoring factor having a plurality of scoring chances to be earned during subsequent performances of individual events by an individual baseball player during the contest; and means for determining at the end of the contest at least one sweepstakes game winner, including providing playing areas on each game card, the playing areas being arranged in an array of three linear rows and three linear columns, and providing marking zones in each playing area, each marking zone being marked when a scoring factor is earned during any one of its respective scoring chances, said game winner being determined when the marking zones lie along a line in the array.

* * * * *